US011131520B2

(12) United States Patent
Kras

(10) Patent No.: US 11,131,520 B2
(45) Date of Patent: Sep. 28, 2021

(54) SUPPRESSOR WITH INTEGRAL FLASH HIDER AND REDUCED GAS BACK FLOW

(71) Applicant: Sig Sauer, Inc., Newington, NH (US)

(72) Inventor: Krzysztof J. Kras, Fremont, NH (US)

(73) Assignee: SIG SAUER, INC., Newington, NH (US)

( * ) Notice: Subject to any disclaimer, the term of this patent is extended or adjusted under 35 U.S.C. 154(b) by 0 days.

(21) Appl. No.: 16/855,726

(22) Filed: Apr. 22, 2020

(65) Prior Publication Data

US 2021/0003360 A1 Jan. 7, 2021

Related U.S. Application Data

(60) Provisional application No. 62/842,685, filed on May 3, 2019.

(51) Int. Cl.
*F41A 21/30* (2006.01)
*F41A 21/34* (2006.01)

(52) U.S. Cl.
CPC ..... *F41A 21/30* (2013.01); *F41A 21/34* (2013.01)

(58) Field of Classification Search
CPC ..... F41A 21/30; F41A 21/34
USPC ..... 89/14.2, 14.4; 181/223
See application file for complete search history.

(56) References Cited

U.S. PATENT DOCUMENTS

| | | | |
|---|---|---|---|
| 1,000,702 | A | 8/1911 | Thurler |
| 1,341,363 | A | 5/1920 | Fiala |
| 1,427,802 | A | 9/1922 | Goodwin |
| 1,462,158 | A | 7/1923 | Wildner |
| 1,736,319 | A | 11/1929 | Maxim |
| 1,773,443 | A | 8/1930 | Wilman |
| 2,101,849 | A | 12/1937 | Green |
| 2,150,161 | A | 3/1939 | Green |
| 2,165,457 | A | 7/1939 | Cutts, Jr. |
| 2,351,037 | A | 6/1944 | Green |
| 2,468,926 | A | 12/1944 | Garrett |
| 2,514,996 | A | 7/1950 | Faust, Jr. |
| 3,368,453 | A | 2/1968 | Shaw |
| 3,385,164 | A | 5/1968 | Walther et al. |
| 3,667,570 | A | 6/1972 | WerBell, III |

(Continued)

FOREIGN PATENT DOCUMENTS

| | | |
|---|---|---|
| EP | 1764577 | 3/2007 |
| GB | 743111 | 1/1956 |

(Continued)

OTHER PUBLICATIONS

Operators Suppressor Systems Info Sheet 2015, 1 page.

(Continued)

*Primary Examiner* — Samir Abdosh
(74) *Attorney, Agent, or Firm* — Finch & Maloney PLLC

(57) ABSTRACT

A suppressor has a suppressor body extending from a proximal end portion to a distal end plate. The suppressor defines an inner chamber with a plurality of baffles and a plurality of outer chambers located radially outside of the inner chamber between the suppressor body and an outer housing. An integral flash hider is located in the distal end portion of the suppressor and exits through a central exit opening in the distal end plate. The outer chambers are largely isolated from the inner chamber and evacuate semi-independently from the inner chamber.

23 Claims, 11 Drawing Sheets

(56) References Cited

U.S. PATENT DOCUMENTS

| | | | |
|---|---|---|---|
| 3,693,750 | A | 9/1972 | Takkunen |
| 3,786,895 | A | 1/1974 | Perrine |
| 4,291,610 | A | 9/1981 | Waiser |
| 4,454,798 | A | 6/1984 | Shea et al. |
| 4,482,027 | A | 11/1984 | Gould |
| 4,501,189 | A | 2/1985 | Brandl et al. |
| 4,510,843 | A | 4/1985 | Rabatin |
| 4,530,417 | A | 6/1985 | Daniel |
| 4,576,083 | A | 3/1986 | Seberger, Jr. |
| 4,583,445 | A | 4/1986 | Blair |
| 4,588,043 | A | 5/1986 | Finn |
| 4,907,488 | A | 3/1990 | Seberger |
| 4,946,105 | A | 8/1990 | Pan, Jr. et al. |
| 4,974,489 | A | 12/1990 | Fishbaugh |
| 5,010,676 | A | 4/1991 | Kennedy |
| 5,029,512 | A | 7/1991 | Latka |
| 5,036,747 | A | 8/1991 | McClain, III |
| 5,078,043 | A | 1/1992 | Stephens |
| 5,092,223 | A | 3/1992 | Hudson |
| 5,136,924 | A | 8/1992 | Forster et al. |
| 5,164,535 | A | 11/1992 | Leasure |
| 5,425,299 | A | 6/1995 | Teetzel |
| 5,433,133 | A | 7/1995 | LaFrance |
| 5,486,425 | A | 1/1996 | Seibert |
| 5,590,484 | A | 1/1997 | Mooney et al. |
| 5,656,166 | A | 8/1997 | Linnersten et al. |
| 5,661,255 | A | 8/1997 | Webb, III |
| 5,679,916 | A | 10/1997 | Weichert |
| 5,698,810 | A | 12/1997 | Rose |
| 5,777,258 | A | 7/1998 | Soon |
| 5,952,625 | A | 9/1999 | Huff |
| 6,079,311 | A | 6/2000 | O'Quinn et al. |
| 6,298,764 | B1 | 10/2001 | Sherman et al. |
| 6,302,009 | B1 | 10/2001 | O'Quinn et al. |
| 6,308,609 | B1 | 10/2001 | Davies |
| 6,374,718 | B1 | 4/2002 | Rescigno et al. |
| 6,376,565 | B1 | 4/2002 | Dyer et al. |
| 6,425,310 | B1 | 7/2002 | Champion |
| 6,490,822 | B1 | 12/2002 | Swan |
| 6,499,245 | B1 | 12/2002 | Swan |
| 6,575,074 | B1 | 6/2003 | Gaddini |
| 6,732,628 | B1 | 5/2004 | Coburn et al. |
| 6,792,711 | B2 | 9/2004 | Battaglia |
| 6,796,214 | B2 | 9/2004 | Hausken et al. |
| 6,959,509 | B2 | 11/2005 | Vais |
| 7,308,967 | B1 | 12/2007 | Hoel |
| 7,587,969 | B2 | 9/2009 | Silvers |
| 7,610,710 | B2 | 11/2009 | Brittingham |
| 7,661,349 | B1 | 2/2010 | Brittingham |
| 7,676,976 | B2 | 3/2010 | Dueck et al. |
| 7,707,762 | B1 | 5/2010 | Swan |
| 7,789,008 | B2 | 9/2010 | Petersen |
| 7,823,314 | B1 | 11/2010 | Wheatley |
| 7,836,809 | B2 | 11/2010 | Noveske |
| 7,870,815 | B2 | 1/2011 | Hung |
| 7,905,319 | B2 | 3/2011 | Sullivan |
| 7,987,944 | B1 | 8/2011 | Brittingham et al. |
| 8,167,084 | B1 | 5/2012 | Moore |
| 8,196,701 | B1 | 6/2012 | Oliver |
| 8,286,750 | B1 | 10/2012 | Oliver |
| 8,307,946 | B1 | 11/2012 | Johnston |
| 8,490,535 | B1 | 7/2013 | Moore et al. |
| 8,516,941 | B1 | 8/2013 | Oliver |
| 8,522,662 | B2 | 9/2013 | Presz, Jr. et al. |
| 8,579,075 | B2 | 11/2013 | Brittingham et al. |
| 8,671,818 | B1 | 3/2014 | Oliver |
| 8,790,434 | B1 | 7/2014 | Oliver |
| 8,826,793 | B2 | 9/2014 | Oliver |
| 8,844,422 | B1 | 9/2014 | Klett |
| 8,973,481 | B2 | 3/2015 | Dueck et al. |
| 9,052,152 | B2 | 6/2015 | Moss et al. |
| 9,163,891 | B1 | 10/2015 | Dater et al. |
| 9,175,920 | B2 | 11/2015 | Moore |
| 9,194,640 | B2 | 11/2015 | Wirth et al. |
| 9,207,033 | B2 | 12/2015 | Vais |
| 9,239,201 | B1 | 1/2016 | Reis Green |
| 9,316,456 | B1 | 4/2016 | Oliver |
| 9,347,727 | B1 | 5/2016 | Cler |
| 9,410,761 | B2 | 8/2016 | Morris et al. |
| 9,423,198 | B1 | 8/2016 | Oliver |
| 9,435,600 | B2 | 9/2016 | Oliver |
| 9,482,484 | B2 | 11/2016 | Barney |
| 9,709,354 | B2 | 7/2017 | Larue |
| 9,835,399 | B1 | 12/2017 | Lessaed |
| 10,024,617 | B1 | 7/2018 | Moore et al. |
| 10,030,929 | B1 | 7/2018 | Lessard |
| 10,126,084 | B1 * | 11/2018 | Oglesby ..... F41A 21/30 |
| 10,228,210 | B2 | 3/2019 | Parker |
| 10,254,068 | B2 | 4/2019 | Piemme et al. |
| 10,371,476 | B1 | 8/2019 | Oglesby |
| 10,393,463 | B1 | 8/2019 | Sanders et al. |
| 10,415,917 | B2 | 9/2019 | White |
| 10,458,739 | B2 | 10/2019 | Smith |
| 10,480,883 | B2 * | 11/2019 | Smith ..... F41A 21/30 |
| 10,480,888 | B2 | 11/2019 | Barrett |
| 10,648,756 | B2 | 5/2020 | Mooty |
| 10,655,926 | B2 | 5/2020 | Young et al. |
| 2007/0107590 | A1 | 5/2007 | Silvers |
| 2007/0107982 | A1 | 5/2007 | Sullivan |
| 2007/0256347 | A1 | 11/2007 | Fitzpatrick et al. |
| 2009/0200105 | A1 | 8/2009 | Geyer, III |
| 2009/0235568 | A1 | 9/2009 | Auvine |
| 2010/0048752 | A1 | 2/2010 | Vignola et al. |
| 2010/0163336 | A1 | 7/2010 | Presz, Jr. et al. |
| 2010/0199834 | A1 | 8/2010 | Dueck et al. |
| 2011/0067950 | A1 | 3/2011 | Shults et al. |
| 2012/0272818 | A1 | 11/2012 | Dueck et al. |
| 2014/0035076 | A1 | 2/2014 | Zhang Xiaozhong; et al. |
| 2014/0262605 | A1 | 9/2014 | Washburn, III et al. |
| 2014/0353076 | A1 | 12/2014 | Bethlenfalvy |
| 2014/0360807 | A1 | 12/2014 | McKenzie |
| 2015/0136519 | A1 | 5/2015 | Moore |
| 2015/0253099 | A1 | 9/2015 | Shults |
| 2015/0260472 | A1 | 9/2015 | Smith |
| 2016/0084602 | A1 | 3/2016 | Smith |
| 2016/0109205 | A1 | 4/2016 | Coppinger et al. |
| 2016/0238335 | A1 | 8/2016 | Bertschinger et al. |
| 2017/0160034 | A1 | 6/2017 | Parker |
| 2017/0299314 | A1 | 10/2017 | Palu |
| 2017/0321984 | A1 | 11/2017 | Palu et al. |
| 2018/0135932 | A1 | 5/2018 | Tomczak |
| 2018/0313626 | A1 * | 11/2018 | Tomczak ..... F41A 21/325 |
| 2018/0313627 | A1 | 11/2018 | Tomczak |
| 2018/0340750 | A1 * | 11/2018 | Mooty ..... F41A 21/30 |
| 2019/0257607 | A1 * | 8/2019 | Dobrinescu ..... F41A 21/30 |
| 2020/0064099 | A1 * | 2/2020 | Young ..... F41A 21/28 |
| 2020/0096279 | A1 | 3/2020 | Hibbitts et al. |
| 2020/0116450 | A1 | 4/2020 | Ellison et al. |
| 2020/0224989 | A1 | 7/2020 | Bundy et al. |
| 2020/0240737 | A1 | 7/2020 | Wheeler et al. |
| 2020/0263947 | A1 | 8/2020 | Calderwood et al. |
| 2021/0071979 | A1 | 3/2021 | Plunkett, Jr. et al. |

FOREIGN PATENT DOCUMENTS

| | | | |
|---|---|---|---|
| GB | 2287780 | A | 9/1995 |
| GB | 2288007 | A | 10/1995 |
| WO | 9902826 | A1 | 1/1999 |
| WO | 2015016998 | | 2/2015 |
| WO | 2020081268 | A2 | 4/2020 |

OTHER PUBLICATIONS

Office Action in U.S. Appl. No. 15/089,165 dated Oct. 20, 2016, 9 pages.

Office Action in U.S. Appl. No. 15/089,165 dated Feb. 16, 2017, 7 pages.

Office Action in U.S. Appl. No. 15/089,165 dated Jul. 13, 2017, 15 pages.

Notice of Allowance in U.S. Appl. No. 15/089,165 dated Aug. 4, 2017, 19 pages.

Office Action in U.S. Appl. No. 15/447,304 dated Nov. 17, 2017, 29 pages.

(56) References Cited

OTHER PUBLICATIONS

Volk, Oleg, "Thermal Defense Solutions: 3D-Printed Inconel Sound Suppresors" AllOutdoor.com, https://www.alloutdoor.com/2018/04/03/thermal-defense-solutions-3d-printed-steel-sound-suppressors/ (Apr. 3, 2018).
RAD 22 Suppressor, OSSSuppressors.com, https://osssuppressors.com/suppressors/rimfire/ (last visited Apr. 29, 2019).
M16A1 Birdcage Flash Hider, RetroRifles.corn, https://retrorifles.com/m16a1-birdcage-flash-hider-4-options/ (last visited Dec. 17, 2019).

* cited by examiner

SUPPRESSOR WITH INTEGRAL FLASH HIDER AND REDUCED GAS BACK FLOW

RELATED APPLICATIONS

This application claims priority under 35 U.S.C. § 119(e) to U.S. Provisional Patent Application No. 62/842,685 titled MONO-CORE SUPPRESSOR WITH INTEGRAL FLASH HIDER AND REDUCED GAS BACK FLOW, filed on May 3, 2019, the contents of which are incorporated herein by reference in its entirety

FIELD OF THIS DISCLOSURE

This disclosure relates to muzzle accessories for use with firearms and more particularly to a suppressor configured for use with automatic firearms.

BACKGROUND

Firearms design involves many non-trivial challenges. In particular, firearms, such as rifles and machine guns, have faced particular complications with reducing the audible and visible signature while also maintaining the desired ballistic performance. Muzzle attachments are designed to be mounted to the muzzle-end of a firearm barrel in one or more particular rotational orientations to accomplish a desired effect. For example, a muzzle brake is a device intended to reduce felt recoil by redirecting a portion of propellant gases sideways or rearward when a shot is fired. A flash hider is another muzzle accessory configured to reduce the visible signature of a firearm by cooling and redirecting gases exiting the barrel. Suppressors are yet another muzzle-end mounted accessory intended to reduce the audible report of the firearm. Suppressors are generally configured to slow the release of pressurized gases from the barrel of the firearm, thereby reducing the audible report when discharging the firearm.

SUMMARY

Disclosed herein is a suppressor assembly and components thereof. In accordance with one embodiment of the present disclosure, a suppressor is configured for use with semi-automatic and automatic rifles, such as a belt-fed machine gun having a high rate of fire. The suppressor has a suppressor body with a mono-core construction. The suppressor body includes and defines an inner chamber for the flow of combustion gases. The inner chamber can include a plurality of baffles and flow-directing structures. Outer chambers are defined between the suppressor body and a tubular outer housing that encloses at least part of the suppressor body. The outer chambers are located radially outside of the inner chamber, such as along the top, bottom, and/or sides of the inner suppressor body.

When a shot is fired, a significant portion of combustion gases is directed to flow through the outer chambers in tandem with a portion of combustion gases that flow through the inner chamber. In some embodiments, the suppressor includes an integral flash hider in the distal end portion, where gases from the inner chamber exit the suppressor through the flash hider. In some embodiments, the inner chamber and the outer chambers evacuate combustion gases in parallel through openings in the distal end of the suppressor. For example, the inner chamber evacuates gases through the flash hider in fluid communication with a central exit opening in the distal end plate, while outer chambers evacuate gases through vent openings in the distal end plate that are radially outside of the central exit opening. The outer chambers can be placed in fluid communication with the inner chamber to promote mixing of gases and more effective filling of the suppressor volume. Advantages of a suppressor as variously described herein include attenuation of the audible report in combination with a reduction in the amount of propellant gases flowing back into the receiver of the firearm. The suppressor also can reduce the firearm's visual signature, in accordance with some embodiments. Numerous variations and embodiments will be apparent in light of the present disclosure.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
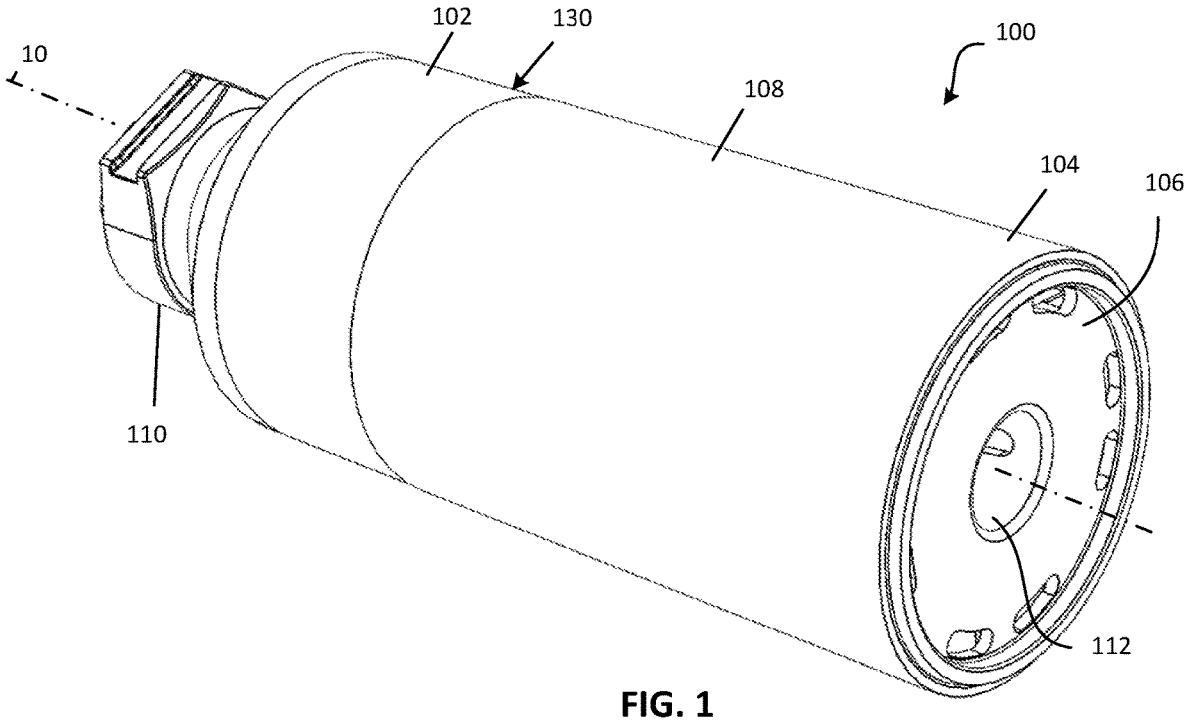
FIG. 1 illustrates a front perspective view of a suppressor, in accordance with an embodiment of the present disclosure.

These and other features of the present embodiments will be better understood by reading the following detailed description, taken together with the figures herein described. For purposes of clarity, not every component may be labeled in every drawing. Furthermore, as will be appreciated, the figures are not necessarily drawn to scale or intended to limit the present disclosure to the specific configurations shown. In short, the figures are provided merely to show example structures.

DETAILED DESCRIPTION

A suppressor for semi-automatic rifles, automatic rifles, and machine guns is disclosed. In accordance with some embodiments, the disclosed suppressor is attachable directly to a firearm barrel or indirectly to the barrel by mounting to a muzzle accessory (e.g., flash hider) attached to the barrel. The suppressor is configured to reduce the audible and/or visual signature of the firearm, in accordance with some embodiments. Compared to existing suppressors, some suppressors of the present disclosure can also reduce the back flow of combustion gases into the gun's receiver after firing. The suppressor can include an integral flash hider in the distal end portion.

In accordance with some embodiments of the present disclosure, a suppressor is configured to provide multiple parallel flow paths for gases to flow from the proximal end portion to the exit at the distal end plate. In one example embodiment, a suppressor includes a suppressor body extending along a central axis from a proximal end portion to a distal end plate that defines a central exit opening. The suppressor body includes a diffusor baffle in the proximal end portion, where the diffusor baffle defines a central opening for passage of a projectile and a portion of combustion gases. An upper partition extends distally from the diffusor baffle to the distal end plate and a lower partition extends distally from the diffusor baffle to the distal end plate, where the lower partition is vertically spaced from the upper partition. Baffles extend between and connect the upper partition to the lower partition. A flash hider in the distal end portion of the suppressor has an expanding passageway in communication with the central exit opening in the distal end plate. The suppressor body defines an inner chamber between the upper partition, the lower partition, the distal end plate, and the diffusor baffle in the proximal end portion.

An outer housing can be installed over the suppressor body and connected at its ends to the distal end plate and to the proximal end portion of the suppressor body. An upper outer chamber is defined between the upper partition and the outer housing. A lower outer chamber is defined between the lower partition and the outer housing. In some embodiments, the suppressor includes lateral partitions along sides of the suppressor body and that extend vertically between lateral end portions of the upper and lower partitions. Lateral outer chambers are defined between the lateral partitions and the outer housing. The upper, lower, and lateral partitions generally define a cuboid volume of the inner chamber. Each of the partitions can include a plurality of flow-directing structures, such as vanes, walls, or other obstructions that require the gases to take a non-linear or tortuous path to the distal end plate.

In some embodiments, the distal end plate defines vent openings from the outer chambers to the environment. In some such embodiments, the outer chambers are evacuated to the environment independently or semi-independently from the inner chamber. For example, gases in the inner chamber evacuate the flash hider through the central exit opening in the distal end plate while gases in the outer chambers evacuate through vent openings in the distal end plate. In other embodiments, the distal end plate omits the vent openings. In such embodiments, gases in the outer chambers flow into the inner chamber through openings or ports through the partitions that place the outer chambers in fluid communication with the inner chamber at various points along the length of the suppressor. In some such embodiments, gases in the outer chamber flow into the inner chamber and mostly vent through the additional ports in the flash hider. Numerous variations and embodiments will be apparent in light of the present disclosure.

General Overview

As noted above, non-trivial issues may arise that complicate weapons design and performance of firearms. For instance, one non-trivial issue pertains to the fact that the discharge of a firearm normally produces audible and visible signatures that result from rapidly expanding combustion gases and from the projectile leaving the muzzle at a velocity greater than the speed of sound. It is generally understood that attenuating the audible report may be accomplished by slowing the rate of expansion of the propellant gases. By slowing down the expansion and release of combustion gases from the muzzle when a shot is fired, conventional suppressor designs result in a build up of pressurized gas within the suppressor, including localized volumes of high-pressure gas. As a natural consequence, the pressurized gases within the suppressor take the path of least resistance to lower pressure. Such condition is generally not problematic in the case of a bolt-action rifle because the operator opens the bolt to eject the spent casing in a time frame that is much greater than the time required for the gases in the suppressor to disperse through the distal (forward) end of the suppressor. However, in the case of a semi-automatic and automatic rifles and machine guns, the bolt opens very quickly after firing (e.g., within 1-10 milliseconds) to reload the firearm for the next shot. In this short time, pressurized gases remain in the suppressor and some of the gases flow through the barrel and out through the chamber toward the operator's face rather than following the tortuous path through the distal end of the suppressor. Back pressure can also cause the firearm's action to cycle more quickly and with more force, which can lead to wear and tear on the firearm and/or malfunctions. To address such challenges, it would be desirable to reduce the pressure build up within the suppressor and to reduce the volume of gases flowing back into the firearm's receiver, or both. It would also be desirable for suppressors to effectively suppress the audible and/or visual signature of the firearm. Accordingly, a need exists for an improved suppressor configured for use with automatic firearms, such as a machine gun. The present disclosure addresses this need, among others.

In accordance with some embodiments of the present disclosure, a suppressor has an inner suppressor body and an outer housing extending along the inner suppressor body. For example, the inner suppressor body has a mono-core construction, such as made using an investment casting process or 3D metal printing (e.g., direct metal laser sintering). In some embodiments, the overall suppressor shape is generally symmetric about a vertical and/or horizontal plane extending longitudinally through the suppressor's central axis. For example, one embodiment includes outside chambers above and below the suppressor body that defines an inner chamber. In another example embodiment, the suppressor body generally has a rectangular cross-sectional shape that defines outer chambers located above, below, and/or to the sides of the inner suppressor body.

In one example embodiment, the suppressor has outer chambers positioned radially outside of an inner or central chamber, which includes a projectile flow path along the central axis. The outer chambers are partially or completely isolated from the inner chamber along the length of the suppressor by a partition or wall. As such, the inner chamber and the outer chambers evacuate combustion gases in tandem. In one example, each outer chamber is largely isolated from the inner chamber by a partition or wall. The inner chamber and the outer chambers can communicate at various locations along the length of the suppressor via openings through the partition separating the inner chamber from the respective outer chamber, in accordance with some embodiments. Openings in the partition between an outer chamber and the inner chamber promote mixing of gases between the chambers and induce localized turbulences as well as breaking up the axial flow of gases in the inner chamber. In addition to flow between the inner and outer chambers, the partitions can include a plurality of flow-directing structures that enhance mixing of gases and filling of the suppressor volume. In one example, the inner chamber generally has a cuboid shape defined within partitions on the top, bottom, and sides of the inner chamber, where each partition may be joined to the outer housing at or near a corner formed with an adjacent partition, thereby defining outer chambers on the top, bottom, and sides of the inner chamber. In another example, top and bottom partitions extend laterally and join the outer housing at the edges of the partition, thereby defining a first outer chamber above the inner chamber and a second outer chamber below the inner chamber.

The suppressor body has a plurality of baffles that each define a central opening along the central axis for the projectile. The baffles extend between and connect an upper partition to a lower partition, where adjacent baffles loosely define compartments within the inner chamber. A diffusor baffle in the proximal end portion is configured to direct a substantial portion of the combustion gases into the outer chambers and exhaust the outer chambers in tandem with gases flowing through the inner chamber. In some embodiments, gases exit the outer chambers to the environment through openings in the distal plate, while gases in the inner chamber exit to the environment through a flash hider in the distal end portion of the suppressor. In other words, each outer chamber is exhausted independently or semi-independently of the inner chamber, and independently or semi-independently of other outer chambers, in accordance with some embodiments. In other embodiments, gases flowing through the outer chambers may flow into the inner chamber via ports and then exit to the environment through ports in an integral flash hider in the distal end portion of the suppressor body. In some embodiments, outer chambers may fluidly communicate with one another so as to permit gas flow between various outer chambers.

In one example embodiment, as combustion gases enter the suppressor from the barrel of a firearm, a diffusor baffle or blast diffusor directs a significant portion (e.g., 25 to 33% or more) of combustion gases to flow through the outer chambers. The remainder of combustion gases passes into the inner chamber, for example. Gases in the outer chambers follow a tortuous path around flow-directing structures (e.g., vanes or baffles) to the distal end portion of the suppressor where the gases can exit to the environment through optional vent openings in the distal end of the suppressor. The design of the outer chambers allows for a substantial portion of gas to flow at velocities higher than the flow through the inner chamber. Therefore, the portion of combustion gases flowing through the outer chambers can be exhausted out of the suppressor faster than the central flow, and the gases flowing through the outer chambers is also is unlikely to flow back into the receiver upon the extraction of the spent case from the barrel's chamber. Thus, the overall volume of gases available to flow back to the receiver is decreased. Openings between the inner and outer chambers along the length of the inner suppressor body also allow gases from the outer chamber to flow into the inner chamber and mix with gases in the inner chamber (and vice versa). Flow of gases through the inner chamber is disrupted by baffles within the inner chamber. Gas flowing into the inner chamber through openings in partitions further disrupts flow along the central axis, resulting in deflection, turbulence, swirling and mixing of combustion gases in addition to enhanced filling of the suppressor volume. One result of such gas flow is that compartments in the inner chamber between adjacent baffles are more evenly filled with gases compared to some other suppressor designs. Also, gas collisions with flow-diverting structures and the associated compression and re-expansion of gases results in loss of heat and energy from the gases. Thus, in addition to suppressing the audible signature of the firearm, the suppressor can also exhibit reduced back flow of gases into the firearm as well as to provide a reduced visible or flash signature, in accordance with some embodiments.

In some embodiments, the suppressor includes an integral flash hider in the distal end portion. The integral flash hider suppresses the visible signature of the firearm by promoting mixing and cooling of combustion gases with ambient gases, which expand outward and redirect the central axis flow to reduce the flash that may result from firing the firearm. In one embodiment, the flash hider includes an expanding passageway (e.g., having a frustoconical shape) in the distal end portion, where the passageway communicates with the inner chamber and with the central exit opening in the distal end plate. Gases in the inner chamber exit the suppressor through the expanding passageway. Some or all of the gases in the outer chambers can flow into the inner chamber and exit through the flash hider. In some embodiments, gases in the outer chambers largely exit to the environment through ports or openings in the outer surface of the flash hider cone.

In other embodiments, gases in the outer chambers largely exit to the environment through optional openings in a distal face of the suppressor as well as through the openings in the outer surface of the flash hider cone.

As will be appreciated in light of this disclosure, and in accordance with some embodiments, a suppressor assembly configured as described herein can be utilized with any of a wide range of firearms, such as, but not limited to, machine guns, automatic rifles, and semi-automatic rifles, among other firearms. In accordance with some example embodiments, a suppressor configured as described herein can be utilized with firearms chambered for ammunition sized from 0.17 HMR rounds to 30 mm autocannon rounds, for example. In some example cases, the disclosed suppressor is configured to be utilized with a rifle chambered for 5.56×45 mm NATO rounds, 7.62×51 mm rounds, 0.338 Norma Magnum, or .50 BMG rounds, to name a few examples. Examples of some host firearms include the SIG MCX™, SIG516™, SIGM400™, or SIG 716™ rifles produced by Sig Sauer, Inc, the Barrett M82/M107, and the FN M240B, Mk 48 and M249 rifles. Other suitable host firearms and projectile calibers will be apparent in light of this disclosure.

In accordance with some embodiments, the disclosed apparatus may be detected, for example, by visual inspection of a suppressor having one or more features including, but not limited to, (i) an inner chamber and a plurality of outer chambers located radially outside of the inner chamber, (ii) a suppressor having a generally planar-symmetric geometry, (iii) a suppressor with an integral flash hider in the distal end portion, (iv) openings between inner and radially outer chambers, (v) an inner suppressor body having a mono-core construction that is encircled by an outer housing, where the suppressor body defines a volume of the inner chamber and outer chambers are defined between the suppressor body and the outer housing, (vi) asymmetric flow-directing structures within the inner and/or outer chambers, and (vii) a suppressor with an inner chamber and outer chambers, where the outer chambers are largely isolated from the inner chamber and vent through the distal face of the suppressor in tandem with the inner chamber venting through a flash hider oriented along the central axis. Also, it should be noted that, while generally referred to herein as a 'suppressor' for consistency and ease of understanding the present disclosure, the disclosed suppressor is not limited to that specific terminology and alternatively can be referred to, for example, as a suppressor assembly, a silencer, a signature-reducing attachment, or other terms. As will be further appreciated, the particular configuration (e.g., materials, dimensions, etc.) of a suppressor configured as described herein may be varied, for example, depending on whether the target application or end-use is military, tactical, or civilian in nature. Numerous configurations will be apparent in light of this disclosure.

Structure and Operation

Figure 2:
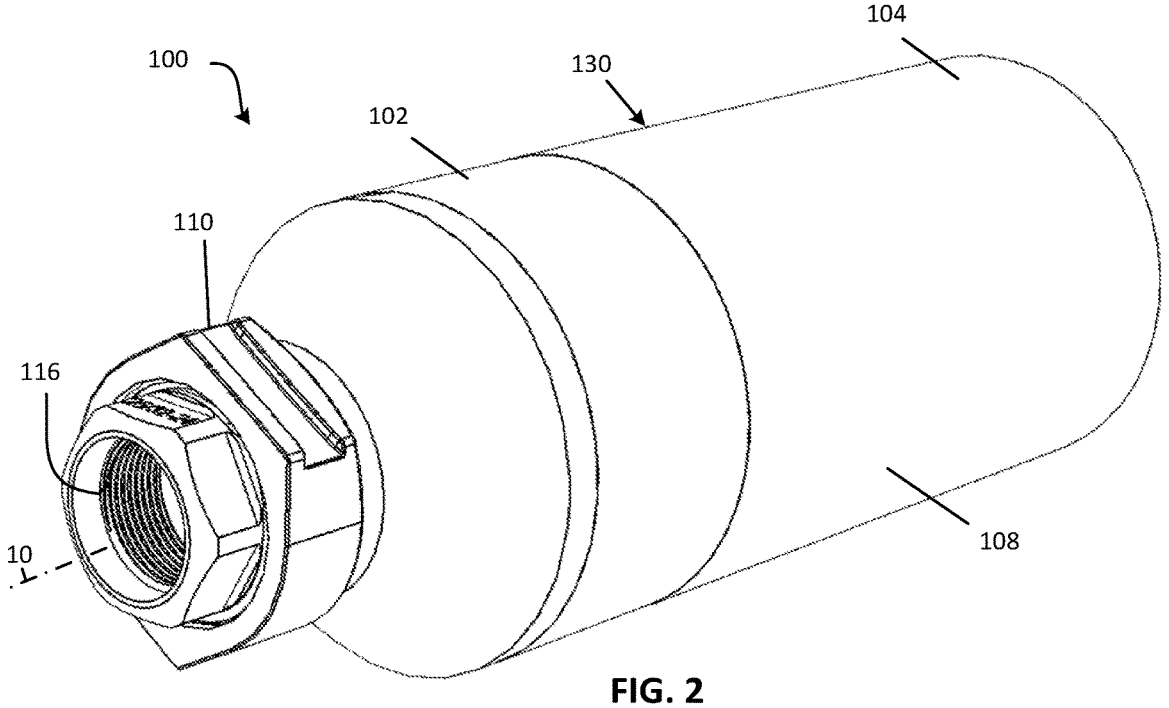
FIG. 2 illustrates a rear perspective view of a suppressor, in accordance with an embodiment of the present disclosure.

FIGS. 1-2 illustrate a front perspective view and a rear perspective view, respectively, of a suppressor 100, in accordance with an embodiment of the present disclosure. The suppressor 100 extends longitudinally along a central axis 10 and includes a suppressor body 130 having a proximal end portion 102 and a distal end portion 104 with a distal end wall or distal end plate 106. A mount 110 is attached to the proximal end portion 102 of the suppressor body 130 and is constructed for securing the suppressor 100 to the barrel of a firearm, either directly or indirectly. For example, the mount 110 can have a threaded mouth 116 for direct attachment to the threaded muzzle-end of a barrel; can be configured to attach to a flash hider, muzzle brake, compensator or other muzzle attachment 114 on the firearm; or can include or attach to an adapter or other intermediate device between the barrel and the mount 110, including a portion of the muzzle attachment 114. The distal end portion 104 of the suppressor body includes or attaches to the distal end plate 106. A flash hider 112 in fluid communication with the inner chamber 136 (shown in FIGS. 6-8) is connected to and opens through the distal end plate 106. An outer housing 108 is attached to and extends along part of the suppressor body 130 from the proximal end portion 102 to the distal end plate 106. The outer housing 108 contains or encircles at least part of the suppressor body 130. In some embodiments, the suppressor 100 generally has a cylindrical shape as generally defined by the proximal end portion 102 of the suppressor body 130 and the outer housing 108; other geometries are acceptable. Numerous variations will be apparent in light of the present disclosure.

Figure 3:
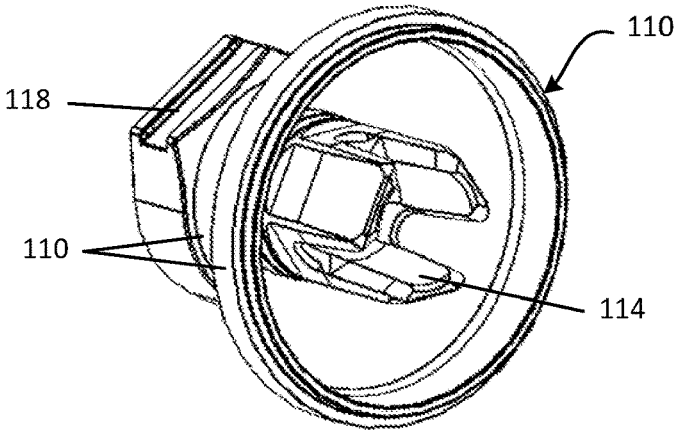
FIG. 3 illustrates a front perspective view of a mount with a muzzle attachment installed in the mount, in accordance with an embodiment of the present disclosure.
Figure 4:
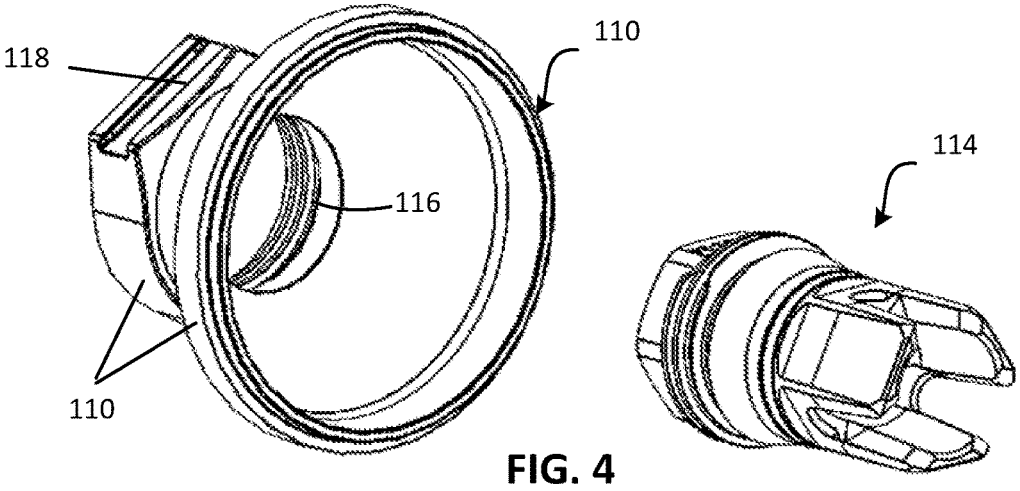
FIG. 4 illustrates front perspective views of the mount and muzzle attachment of FIG. 3 in a disassembled form, in accordance with an embodiment of the present disclosure.

Referring now to FIGS. 3-4, perspective views illustrate a mount 110 that includes a muzzle attachment 114 configured to be attached to a firearm barrel, in accordance with an embodiment of the present disclosure. As shown in FIG. 3, the muzzle attachment 114 can be secured into the mouth 116 of the mount 110 by threaded engagement. FIG. 4 shows the muzzle attachment 114 separate from the mount 110. In this example embodiment, the muzzle attachment 114 is configured as a flash hider that can be attached to the muzzle-end of a barrel, such as by threaded engagement. An outside of the mouth 116 includes wrench flats 118 for securing and aligning the suppressor 100 to the firearm, as will be appreciated. Moving distally from the mouth 116, the mount 110 expands in size for attachment with the proximal end portion 102 of a suppressor body 130. The mount 110 can be secured to the suppressor body 130 by threaded engagement, welding, or other suitable assembly means, or the mount 110 and suppressor body 130 can be made as a single, monolithic piece. In one embodiment, the mount 110 and suppressor body 130 are constructed to be reversibly assembled so as to enable disassembly of the suppressor 100 for cleaning, maintenance, and/or to exchange the particular mount 110 attached to the suppressor body 130, for example.

Figure 5:
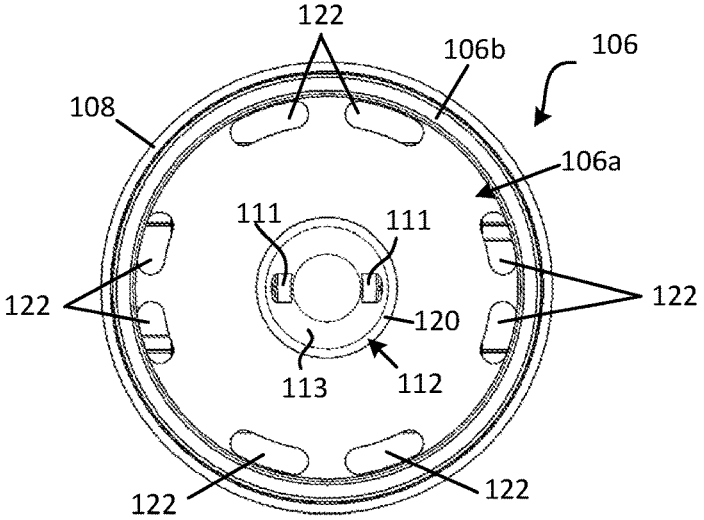
FIG. 5 illustrates a front view of a distal end plate and flash hider of a suppressor, in accordance with an embodiment of the present disclosure.

FIG. 5 illustrates the distal end face **106*a* of a distal end plate 106 and integral flash hider 112, in accordance with one embodiment of the present disclosure. The flash hider 112 is centrally located and is joined to the distal end plate 106 along a central opening 120. The outer housing 108 is secured to the distal end plate 106 along the rim or outer margin 106*b*, such as by welding. The distal end plate 106 optionally defines a plurality of radially outer vent openings 122 that fluidly communicate directly with outer chambers 140 of the suppressor, which are discussed in more detail below. In one embodiment, each vent opening 122 corresponds to an individual outer chamber 140. In other embodiments, a particular outer chamber 140 may communicate with one or more vent openings 122. As illustrated in this example embodiment, pairs of vent openings 122 at the twelve o'clock position, three o'clock position, six o'clock position, and nine o'clock position correspond to outer chambers at the top, left, bottom, and right sides, respectively, of the suppressor 100. Vent openings 122 may be symmetrically or asymmetrically arranged and can have any of a variety of shapes, including circular, oval, arcuate slot, polygonal, or other shape. The vent openings 122 can be located radially between the central opening 120 and outer margin 106*b* of the distal plate 106 so long as the vent openings 122 are positioned to communicate with a corresponding outer chamber 140. In the example embodiment shown, vent openings 122 are located closely adjacent the outer margin 106***b* and gases can exit from the outer chambers via the vent openings 122. In some embodiments, the distal end plate 106 omits vent openings 122 as one method to reduce visible flash from the suppressor 100. In some such embodiments, the flash hider 112 can be configured for increased flow through the central opening 120, such as by defining vent openings 111 in the sidewall of the flash hider's passageway. Note, however, that the wall 113 defining the flash hider's central passageway can define vent openings 111 regardless of whether the distal end plate 106 includes vent openings 122.

Figure 6:
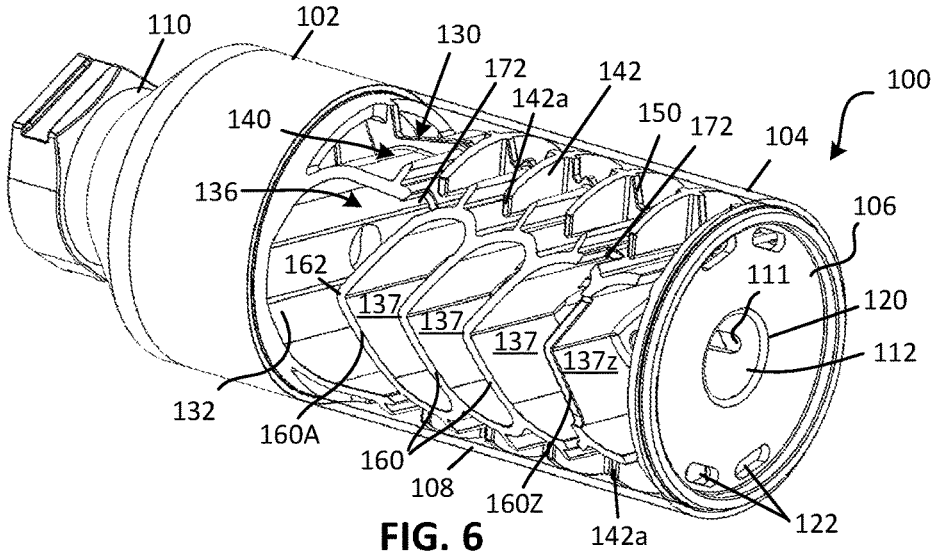
FIG. 6 illustrates a front and side perspective view of a suppressor shown with only a portion of the outer housing, in accordance with an embodiment of the present disclosure.
Figure 7:
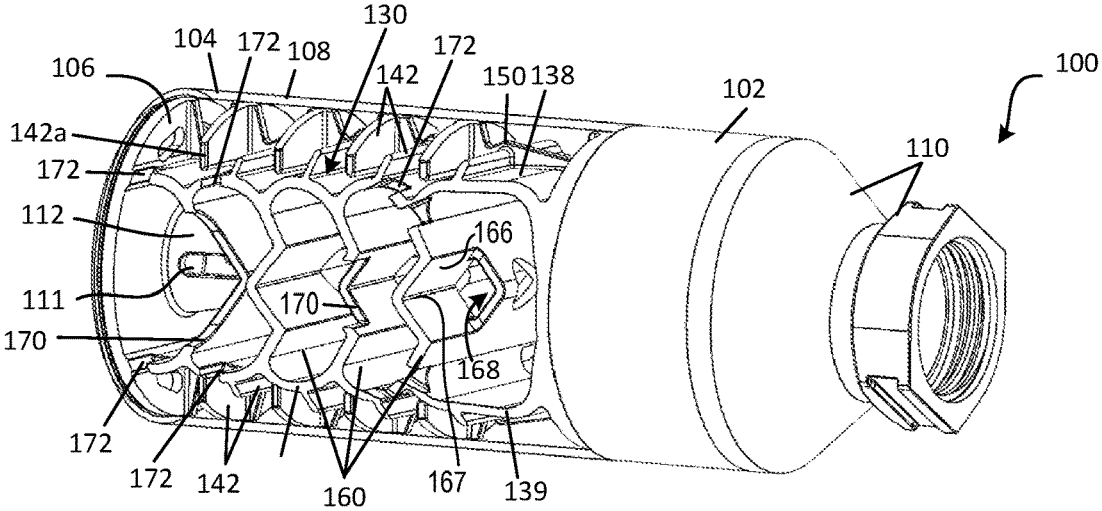
FIG. 7 illustrates a side and rear perspective view of a suppressor shown with only a portion of the outer housing, in accordance with an embodiment of the present disclosure.
Figure 8:
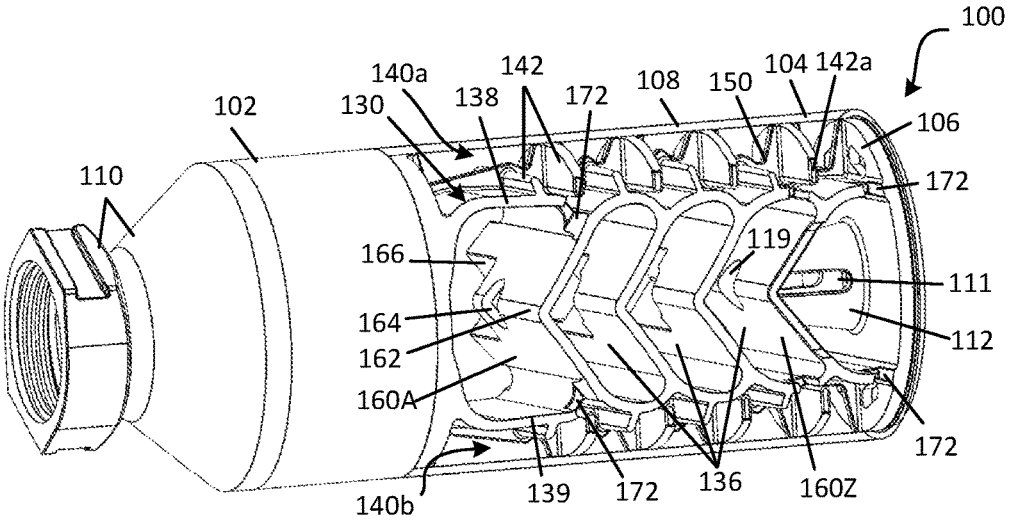
FIG. 8 illustrates a perspective view showing the right and rear sides of the suppressor of FIG. 6, in accordance with an embodiment of the present disclosure.
Figure 9:
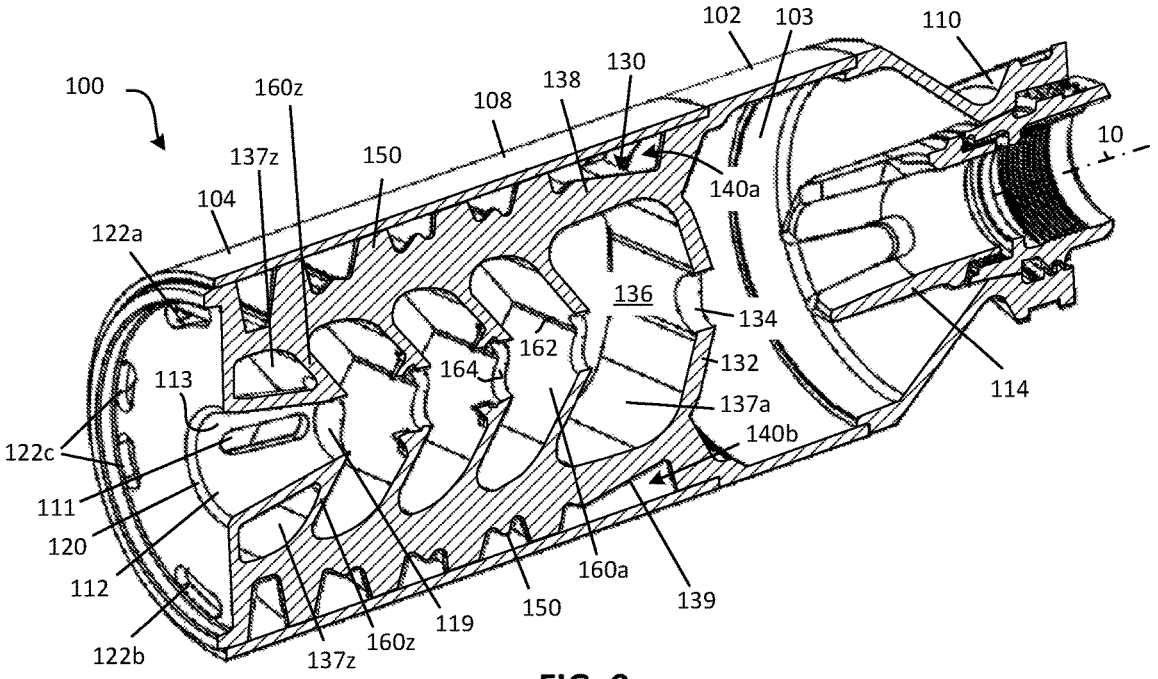
FIG. 9 illustrates a top and front perspective sectional view showing the right half of a suppressor, where the section is taken along a central vertical plane, in accordance with an embodiment of the present disclosure.
Figure 10:
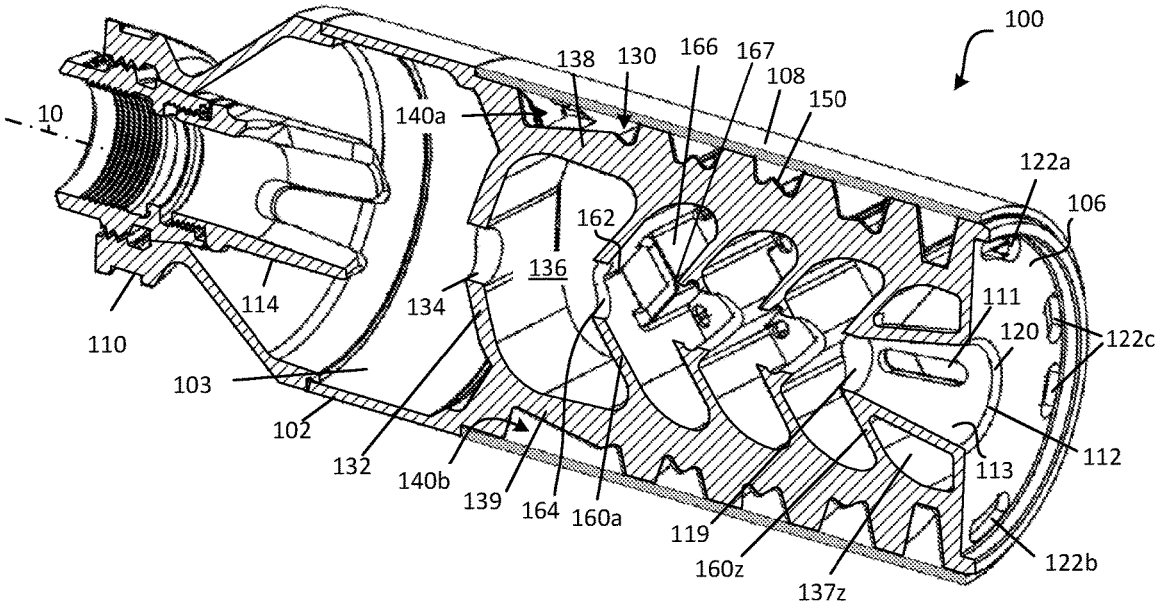
FIG. 10 illustrates a top and front perspective view showing the left half of a suppressor, where the section is taken along a central vertical plane, in accordance with an embodiment of the present disclosure.

Referring now to FIGS. 6-10, partial sectional, perspective views illustrate a suppressor 100 in accordance with an embodiment of the present disclosure. The perspective views of FIGS. 6-8 show the front and right sides, the rear and left sides, and the rear and right sides, respectively, of the suppressor 100. In these figures, part of the outer housing 108 is omitted to more clearly show structure of the suppressor body 130. The perspective sectional views of FIGS. 9 and 10 show the suppressor as viewed from the front and left sides, and as viewed from the front and right sides, respectively, where the section is taken along a vertical plane extending axially through the suppressor 100, in accordance with one embodiment.

In this example embodiment, the suppressor 100 includes a suppressor body 130 with a cylindrical and generally hollow proximal end portion 102. The proximal end portion 102 defines a relatively voluminous blast chamber 103 that provides space for combustion gases to expand as the gases exit the barrel and enter the suppressor 100. As shown in this example, the blast chamber 103, at least partially defined by the proximal end portion 102, is sized to accommodate a muzzle attachment 114, such as a muzzle brake or flash hider installed on the barrel. In one embodiment, the proximal end portion has an axial length of ⅜ inch or more, 0.5 inch or more, 1.0 inch or more, 1.5 inches or more, about 2 inches, 2 inches or more, from 1-2 inches, or from 1.5 to 2.5 inches. A greater axial length may allow the combustion gases to expand to a greater extent upon leaving the barrel, which may promote more gas flow into the outer chambers 140 rather than along the central axis 10; however, increased axial length comes at the cost of overall size of the suppressor 100, and in some circumstances may cause an increase in the volume of gas flowing back into the firearm's receiver, as will be appreciated. The proximal end portion 102 can be integral to the suppressor body 130, can be integral to the mount 110, or can be a separate component that attaches between the mount 110 and the suppressor body 130.

As shown in FIGS. 9-10, the suppressor body 130 includes a diffusor baffle 132 in or adjacent the proximal end portion 102, in accordance with some embodiments. The diffusor baffle 132 defines a central opening 134 to permit a projectile and a portion of combustion gases to pass into an inner chamber 136. The diffusor baffle 132 is also constructed to direct a portion of combustion gases to outer chambers 140 located above and below the inner chamber 136, for example. As a general matter, the diffusor baffle 132 can extend fully or partially between opposite lateral sides of the outer housing 108 and partially between opposite top and bottom sides of the outer housing 108. In one embodiment that includes upper and lower outer chambers 140, the diffusor baffle 132 extends laterally between opposite sides of the outer housing 108 and vertically between an upper partition 138 and a lower partition 139. In one example, the diffusor baffle 132 has a generally planar portion surrounding the central opening 134 that extends to and is continuous with angled or curved upper and lower portions that are continuous with the upper partition 138 and lower partition 139, respectively. In another example, the diffusor baffle 132 has a domed or convex shape that protrudes rearwardly towards the mount 110. In another example, the diffusor baffle 132 has a tetrahedral or frustoconical shape that expands in size moving distally. In any such embodiments, the diffusor baffle 132 defines central opening 134. In yet another example, the diffusor baffle 132 has a planar, angled, convex, or other geometry and optionally defines one or more radially outer openings 144 (shown in FIG. 11). The radially outer openings 144 may communicate with the outer chambers 140, may simply provide an alternate flow path into the inner chamber 136 allowing for more uniform filling of the initial space in the central chamber, or both.

In one embodiment, the suppressor body 130 includes an upper partition 138 and a lower partition 139 that extend distally from the proximal end portion 102 and/or diffusor baffle 132 to the distal end plate 106. Each of the upper partition 138 and the lower partition 139 extends laterally to and optionally engages or is joined to the outer housing 108. As a result, an upper outer chamber 140*a* is defined between the upper partition 138 and the outer housing 108, and a lower outer chamber 140*b* is defined between suppressor body 130 and the outer housing 108, where each outer chamber 140 generally has a cross-sectional shape of a chord. The upper partition 138 and the lower partition 139 can be planar, can have an undulating shape, a zig-zag shape, or some other shape as the partition 138, 139 extends distally.

In some embodiments, the upper partition 138 and lower partition 139 each define one or more walls, vanes, or other flow-directing structure 142 that extends partially or fully between the partition and the outer housing 108, defining a tortuous path designed to obstruct or divert gas flow as gases travel distally through the outer chamber 140. In general, the flow-directing structures 142 are barriers that force gases to flow along a non-linear, tortuous path through an outer chamber 140 from the proximal end portion 102 to the distal end plate 106. For example, flow-directing structures 142 are vertical walls that extend up from the upper partition 138 partially or completely to the outer housing 108, or downward from the lower partition 139 to the outer housing 108. The flow-directing structures 142 can connect to (extend from) the partition, from the outer chamber 108, or both. In another example, flow-directing structures 142 extend partially across the partition 138, 139 in the lateral direction, and extend the full vertical distance between the partition and the outer housing 108, so as to define a gas pathway around the lateral end 142*a* of the flow-directing structure 142 near the outer housing 108. In another example, flow-directing structures 142 are vanes attached to the partition, to the outer housing, or both that force gases to flow over, around or below the vane. In one such embodiment, the vanes are arranged in such a way to promote a tortuous or serpentine path for gases as the gases flow distally between sequential vanes. One or more varieties of flow-directing structures can be used in combination in each outer chamber 140.

In one embodiment, one or more of the outer chambers 140 can be divided into two or more compartments by an axially extending spine 150. For example, in the embodiment of FIGS. 6-10 having an upper outer chamber 140*a* and a lower outer chamber 140*b*, the spine 150 extends axially along the upper and lower partitions 138, 139 longitudinally from the diffusor baffle 132 to the distal end plate 106. The spine 150 also extends vertically from the upper partition 138 or lower partition 139 partially or completely to the outer housing 108. In one such embodiment, the spine 150 extends completely between the upper partition 138 and the outer housing 108 along its length so as to divide the upper outer chamber 140*a* into separate left and right upper outer chambers that are isolated from each other along the spine 150. In another embodiment, the spine 150 has an undulating shape that connects the partition to the outer housing 108 only at some locations along the length of the spine 150. In yet another embodiment, the spine 150 extends only partially between the upper partition 138 and the outer housing 108 so as to divide the upper outer chamber 140*a* into left and right outer chambers that communicate with each other. In an example embodiment where the right and left outer chambers communicate with each other, flow-directing features 142 in a right side of the upper outer chamber 140*a* can be asymmetrical with flow-directing features 142 in the left side of the upper outer chamber 140*a* to promote gas mixing between the right and left sides of the upper outer chamber 140*a*, for example. Although discussed here for the upper outer chamber 140, these features can similarly be applied to any of the other outer chambers 140.

The suppressor body 130 defines one or more baffles 160 in the inner chamber 136 and axially between the diffusor baffle 132 and the distal end plate 106. In one embodiment, each baffle 160 extends between and connects the upper partition 138 to the lower partition 139. Each baffle 160 can have any of a variety of shapes that promote turbulent flow of combustion gases and define a central baffle opening 164 for passage of a projectile and combustion gases. In one embodiment, the baffles 160 define a V-shape where the vertex 162 of the V-shape extends horizontally across at least a portion of the inner chamber 136 and points rearwardly. In one such embodiment, the vertex 162 is vertically located at or near the central axis 10. In one embodiment, such as shown in FIGS. 7-8, a side portion 166 of one or more baffles 162 defines a forward-extending V-shape with a smaller vertex 167 that points in an opposite direction of the vertex 162 (e.g., a main vertex). For example, the side portion 166 is located to one side of the central baffle opening 164 and has a vertical height that is approximately one third to one half of the overall vertical height of the baffle 160. The side portion 166 defines a side opening 168 between the main vertex 162 of the baffle 160 and the smaller vertex 167 of the side portion 162 where gases can flow laterally across the baffle 160 surface. Baffles 160 and side portions 166 could similarly be formed with convex or domed surfaces, for example, that extend axially in opposite directions. In the example embodiments shown, the baffles 160 have an asymmetrical geometry from left to right that promotes turbulent flow and filling of the inner chamber 136. Specifically, lateral flow of gases through the side opening 168 may intersect and disrupt gas flow along the central axis 10 to prevent the high-energy central gas flow from directly exiting the suppressor 100, which in general would result in the increase in sound and flash signatures, as will be appreciated. Such flow paths can also result in more even filling of compartments 137 of the inner chamber 136 and improved energy dissipation and heat transfer from the gases to the suppressor 100.

Each baffle 160 can extend laterally partially or completely to the outer housing 108, in accordance with some embodiments. For example, one or more of baffles 160 optionally defines one or more outer baffle opening 170 adjacent the outer housing 108. As shown in FIG. 7, for example, outer baffle openings 170 of various baffles 160 can have different sizes and locations. For example, one baffle 160 may define outer baffle openings 170 above and below the side portion 166 adjacent the intersection with the upper and lower partitions 138, 139, respectively. In another baffle 160, the outer baffle opening 170 is defined in the side portion 166. In another baffle 160, the outer baffle opening 170 is a V-shaped or arcuate cut that extends laterally into the side of the baffle 160 adjacent the outer housing 108 between the upper and lower partitions 138, 139. Each outer baffle opening 170 enables an alternate flow path for gases around the lateral edges of the baffles 160. Stated differently, outer baffle openings 170 enable gases to travel between compartments 137 defined between adjacent baffles 160 by taking a flow path that is longer than through the central baffle opening 164. Again, asymmetry in the various outer baffle openings 170 may promote turbulent flow and efficient filling of the inner chamber 136.

In addition to many flow path options and variations within the inner chamber 136, the suppressor body 130 optionally defines one or more partition openings 172 between one or more of the outer chambers 140 and the inner chamber 136. As best seen in FIGS. 6-8, for example, each of the upper partition 138 and the lower partition 139 define partition openings 172 to place the outer chambers 140 in fluid communication with the inner chamber 136. The partition openings 172 can be positioned in any location, including adjacent the outer housing 108. In one embodiment, one or more of the partition openings 172 are positioned so that gases flowing from the outer chamber 140 to the inner chamber 136 will flow along a proximal face of a baffle 160. Various partition openings 172 can have different or the same lateral widths and opening areas that are the same or different. In one embodiment, since baffles have a V-shape or curved shape, for example, gas flow from the upper outer chamber 140*a* or lower outer chamber 140*b* into the inner chamber 136 may be incident to the rearward-angled face of a baffle 160, therefore causing gases to flow in a generally rearward direction. Such flow would enhance gas mixing, turbulent flow, and filling the volume of the suppressor 100. In particular, a partition opening 172 proximally located with respect to the first (proximal) baffle 160*a* may enhance filling of the compartment defined between the first baffle 160 and the diffusor baffle 132.

In the distal end portion 104, a flash hider 112 is connected to and extends between the distal end plate 106 and the final baffle 160*z*, in accordance with one embodiment. For example, the flash hider 112 resides in the last compartment 137*z* of the inner chamber 136 that is defined between the distal end plate 106 and the final baffle 160*z*. The flash hider 112 has an entrance opening 119 and an exit via central opening 120 in distal end plate 106. The flash hider 112 has an expanding volume as it extends distally, such as a frustoconical passageway. In some embodiments, the wall 113 defining the passageway of the flash hider 112 defines one or more flash hider vents 111 to place the final compartment 137*z* of the inner chamber 136 in fluid communication with the flash hider 112 passageway. Flash hider vents 111 can have any one or more of a variety of shapes, including round, elongated slot, ovoid, rectangular, or the like. Flash hider 112 can have any number of flash hider vents 111, such as two, four, or six vents to name a few examples. In one embodiment, the flash hider 112 has two flash hider vents 111 located at the three o'clock and nine o'clock positions. In another embodiment, four flash hider vents 111 are located at approximately the two, four, eight, and ten o'clock positions. In another embodiment, flash hider vents 111 are positioned at the three, six, nine, and twelve o'clock positions. In one embodiment, the combined area of the flash hider vents 111 is equal to or greater than the area of the entrance opening 119 to the flash hider 120. Embodiments of flash hider 112 that define flash hider vents 111 can be advantageous whether or not the distal end plate 106 defines any vent openings 122 since the increased area of the flash hider vents 111 can enhance efficient evacuation of the suppressor 100. Numerous variations and embodiments will be apparent in light of the present disclosure.

As can be seen in the sectional views of FIGS. 9 and 10, the distal end plate 106 optionally defines vent openings 122 that enable the outer chambers 140 to vent directly to the environment. For example, vent openings 122*a* correspond to the upper outer chamber 140*a*, vent openings 122*b* correspond to the lower outer chamber 140*a*, and vent openings 122*c* correspond to the lateral outer chambers 140*c* (lateral outer chambers 140*c* are discussed in more detail below). Vent openings 122 provide a pathway for gases to the environment from outer chambers 140. As such, the suppressor 100 can evacuate the outer chambers 140 in tandem with the inner chamber 136, where the outer chambers 140 vent independently or semi-independently from the inner chamber 136.

Figure 11:
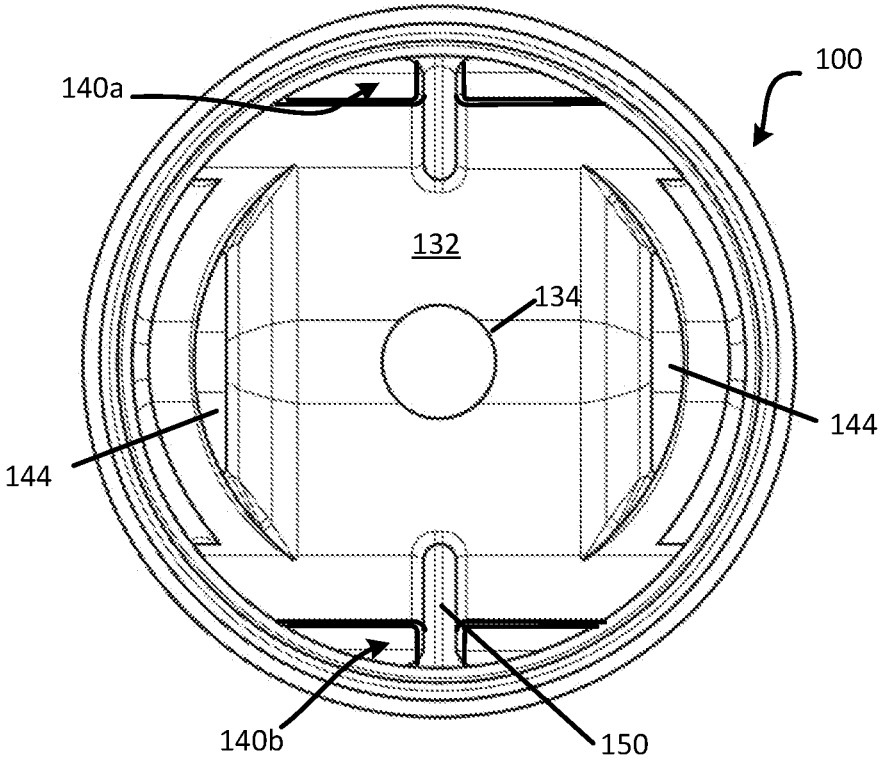
FIG. 11 illustrates a rear view of a diffusor baffle, in accordance with an embodiment of the present disclosure.
Figure 12:
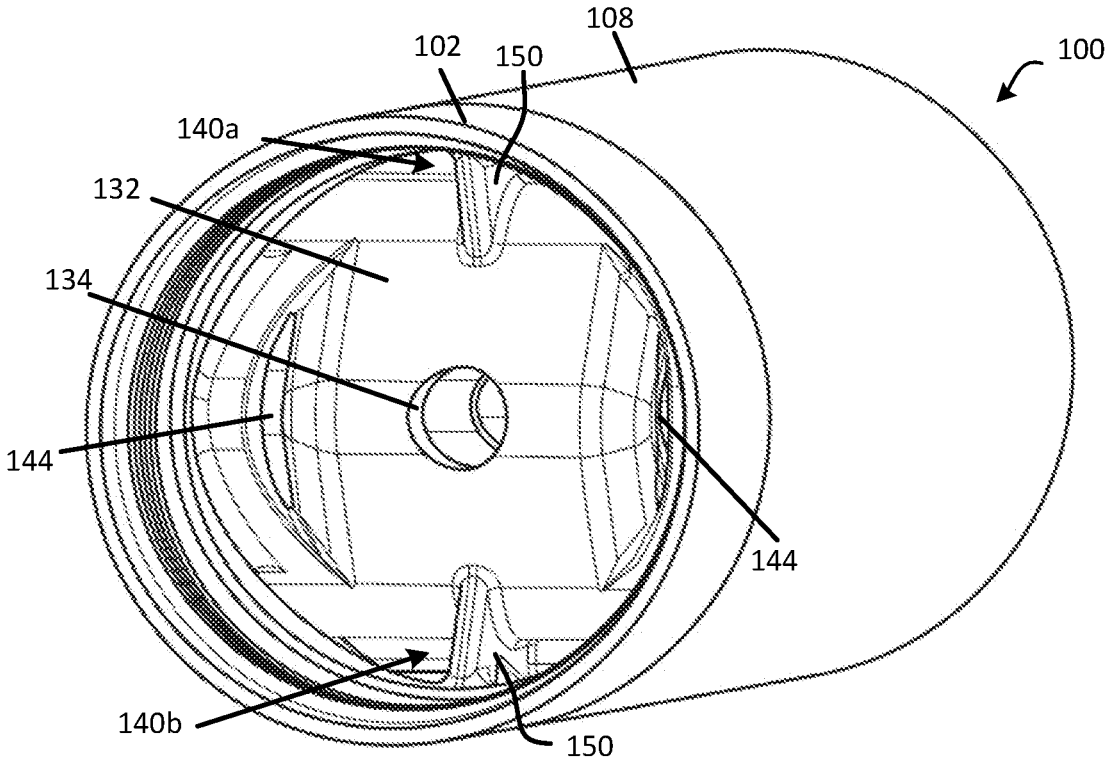
FIG. 12 illustrates a rear perspective view of the diffusor baffle of FIG. 11, in accordance with an embodiment of the present disclosure.
Figure 13:
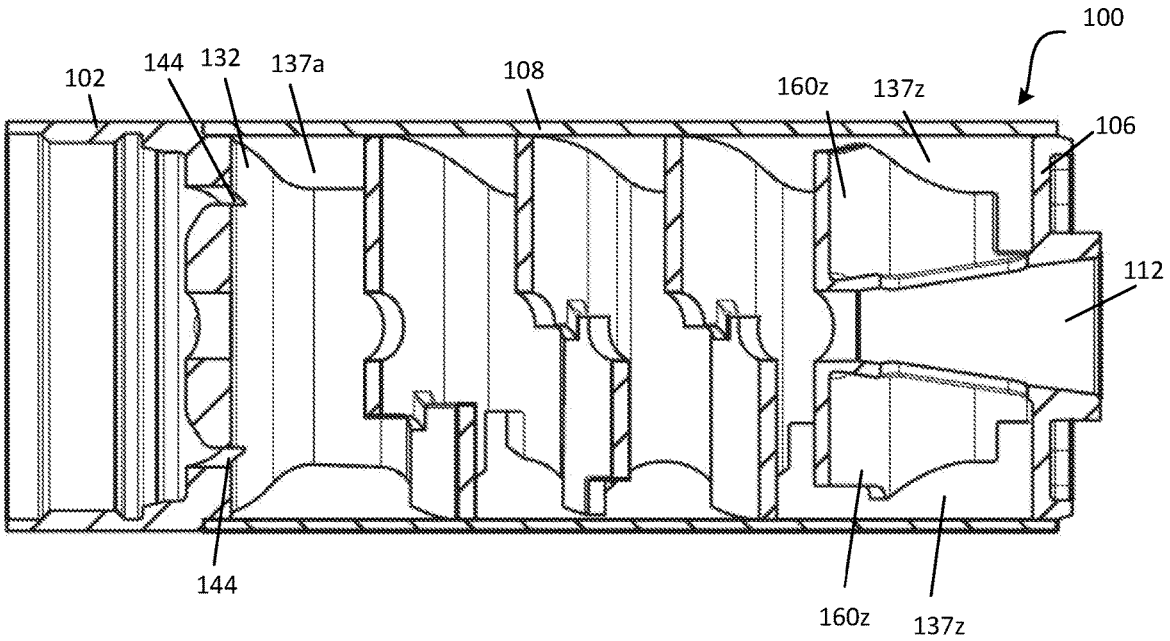
FIG. 13 illustrates a top sectional view of a suppressor showing the bottom half of the suppressor, where the section is taken along a central horizontal plane, in accordance with an embodiment of the present disclosure.
Figure 14:
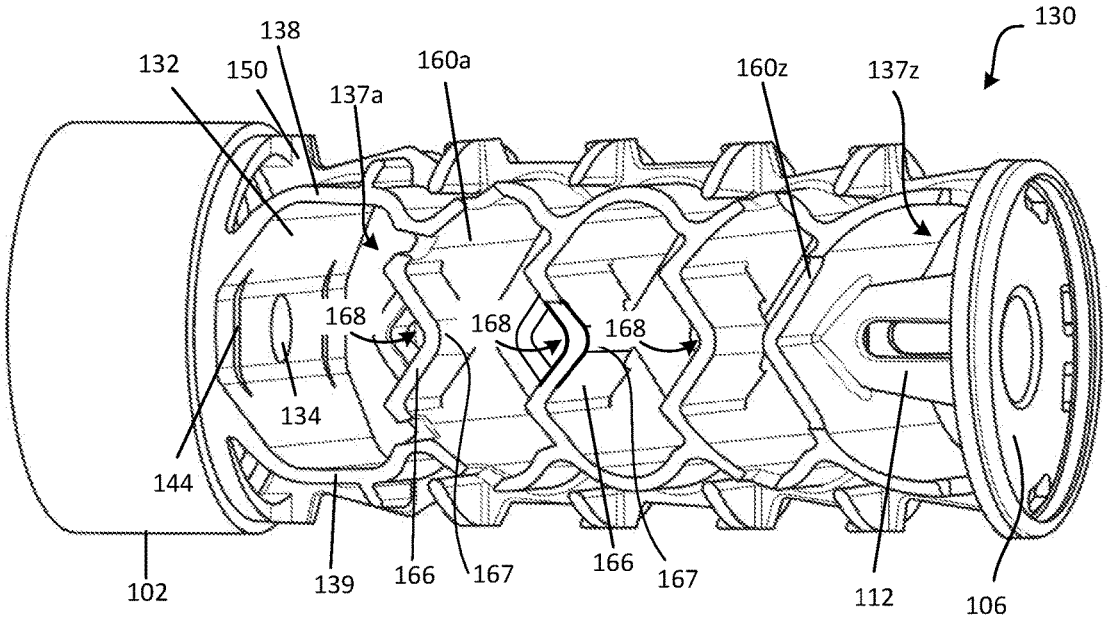
FIG. 14 illustrates a front and side perspective view showing a mono-core suppressor body, in accordance with an embodiment of the present disclosure.

Referring now to FIGS. 11-14, various views illustrate a diffusor baffle 132 that defines radially outer openings 144, in accordance with one embodiment. FIG. 11 and FIG. 12 illustrate an end view and a perspective view, respectively, showing the diffusor baffle 132; FIG. 13 illustrates a top view showing part of suppressor 100 sectioned along a horizontal plane; and FIG. 14 illustrates a side perspective view showing the suppressor body 130 without the outer housing 108. In this embodiment, the diffusor baffle 132 has a generally angled or arcuate shape with a vertex extending horizontally across the diffusor and pointing rearwardly. This shape promotes gas flow around the diffusor baffle 132 in an upward direction to the upper outer chamber 140*a* and in a downward direction to the lower outer chamber 140*b*. The diffusor baffle 132 also defines radially outer openings 144 to the right and left of the central opening 134. The radially outer openings 144 are spaced laterally from the central opening 134 and have a crescent shape that is oriented vertically; other shapes are acceptable. The radially outer openings 144 provide an alternate gas flow path into the inner chamber 136 rather than through the central opening 134. The radially outer openings 144 facilitate filling the first compartment 137*a* defined between the diffusor baffle 132 and the first baffle 160*a*. Optionally, the entrance to each radially outer opening 144 can be sloped or enlarged to facilitate gas flow into the radially outer openings 144. FIGS. 13 and 14 also show flash hider 112 in the final compartment 137*z* between the distal end plate 106 and the final baffle 160*z*, in accordance with one embodiment.

Figure 15:
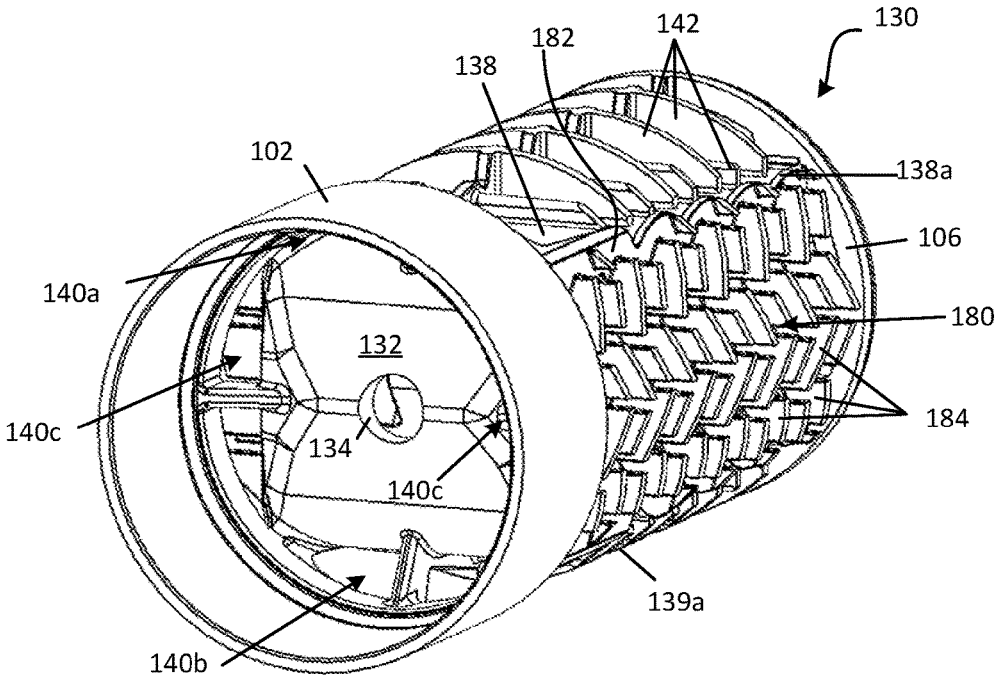
FIG. 15 illustrates a right and rear perspective view of a suppressor body that includes side partitions and is shown without the outer housing, in accordance with an embodiment of the present disclosure.
Figure 16:
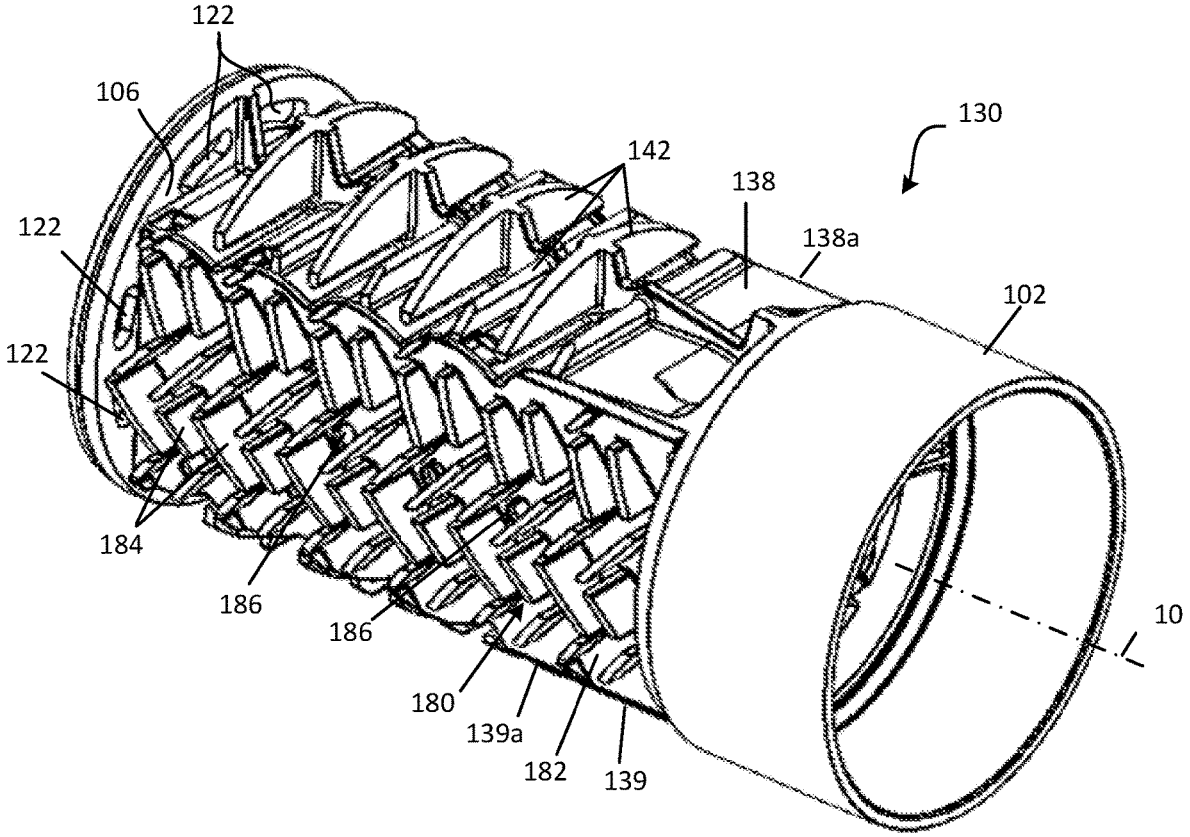
FIG. 16 illustrates a top, left, and rear perspective view of a suppressor body with side partitions and is shown without the outer housing, in accordance with an embodiment of the present disclosure.
Figure 17:
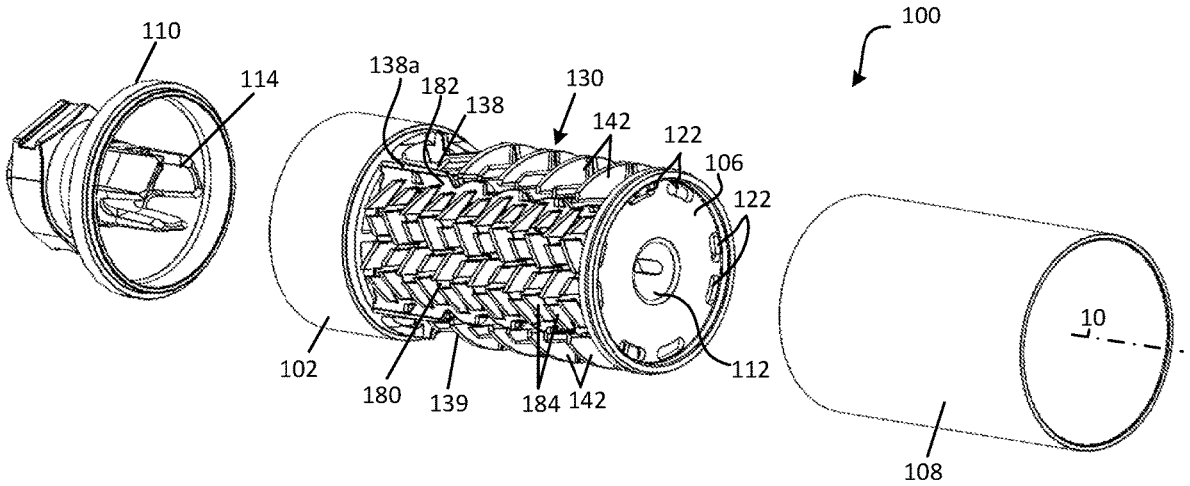
FIG. 17 illustrates a partially exploded front perspective view showing components of a suppressor assembly, in accordance with an embodiment of the present disclosure.
Figure 18:
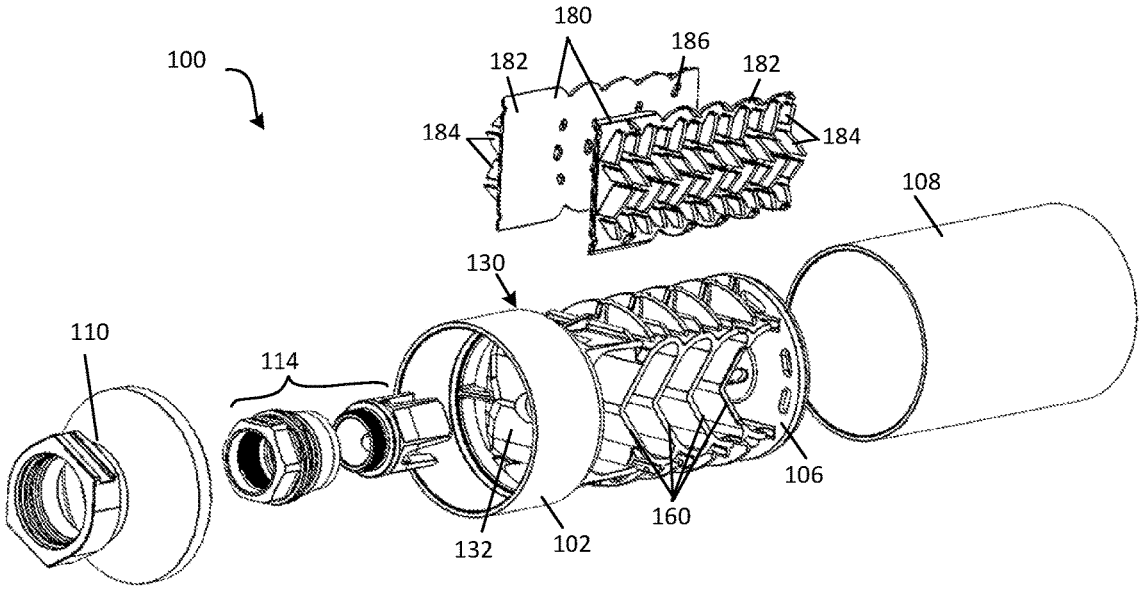
FIG. 18 illustrates an exploded, side, and rear perspective view showing components of a suppressor assembly, in accordance with an embodiment of the present disclosure.

Referring now to FIGS. 15-18, various perspective views show a suppressor 100 and components thereof in accordance with another embodiment of the present disclosure. FIG. 15 illustrates the rear and right sides of a suppressor body; FIG. 16 illustrates the top, rear, and left sides of a suppressor body; FIG. 17 illustrates a partially exploded perspective view showing the front and right sides of the mount 110, suppressor body 130, and outer housing; and FIG. 18 illustrates a more fully exploded perspective view showing components of the suppressor 100. Similar to embodiments discussed above, the suppressor 100 includes a suppressor body 130 extending along a central axis 10 between a proximal end portion 102 and a distal end plate 106. The suppressor body 130 has an upper partition 138 and lower partition 139 connected at the proximal ends to diffusor baffle 132. An inner chamber 136 is defined between the upper partition 138, the lower partition 139, the distal end plate 106, and the diffusor baffle 132. A plurality of baffles 160 extend between and connect the upper partition 138 to the lower partition 139. An upper outer chamber 140*a* is defined between the upper partition 138 and the outer housing 108, and a lower outer chamber 140*b* is defined between the lower partition 139 and the outer housing 108. The upper outer chamber 140*a* and lower outer chamber 140*b* each generally have a chord-like cross-sectional shape.

Side partitions 180 extend vertically between the upper partition 138 and the lower partition 139. In one embodiment, each side partition 180 engages, is joined to, or is in close proximity to lateral margins 138*a* of the upper partition 138 and lateral margins 139*a* of the lower partition 139. For example, the side partitions 180 generally define a corner with the upper partition 138 and lower partition 139. The side partitions 180 can be secured to the upper and lower partitions 138, 139, such as by welding, but this is not required in all embodiments. In some embodiments, the side partitions 180 are recessed slightly inward from the lateral margins 138*a*, 139*a* such that the upper partition 138 and/or the lower partition 139 overhangs the body of the side partitions 180, which is generally planar in this example embodiment. As such, the upper and lower partitions 138, 139 and the side partitions 180 partially define and enclose a generally cuboid volume of the inner chamber 136. The suppressor 100 defines a lateral outer chamber 140*c* between each side partition 180 and the outer housing 108. In some embodiments, each lateral outer chamber 140*c* is isolated from direct fluid communication with the upper outer chamber 140*a* and/or the lower outer chamber 140*b*. In other embodiments, the intersection or corner between the side partition 180 and the upper partition 138 or lower partition 139 defines openings or otherwise permits direct fluid communication between the outer chambers 140. Similar to upper and lower outer chambers 140*a*, 140*b*, lateral chambers 140*c* evacuate independently or semi-independently from the inner chamber 136, in accordance with some embodiments. Note that while illustrated and described as having a generally cuboid geometry with a rectangular cross-sectional shape, the suppressor body 130 could define other cross-sectional shapes, such as a triangle, trapezoid, pentagon, hexagon, etc. In some such embodiments, for example, a partition can be attached to or assembled with the suppressor body 130 to define 3, 4, 5, 6, or other number of outer chambers between the partition and the outer housing 108. In some embodiments, some of the partitions that define and enclose the inner chamber 136 may be parallel to or non-parallel to other partitions in the suppressor 100.

In one embodiment, each side partition 180 includes a plurality of flow-directing structures 184 extending laterally from the partition body 182, such as vanes, ribs, protrusions, or other obstacle that requires the gases to take a non-linear path from the diffusor baffle 132 to vents 122 in the distal end plate 106. In one embodiment, vanes are arranged in an open herringbone pattern, where a row of vanes are generally parallel to one another and extend in a first direction, a second row of vanes are generally parallel to one another and extend in a different second direction to define a pattern of disconnected Vs and inverted Vs. In some such arrangements, gases must take a serpentine or other tortuous path from the diffusor baffle 132 to reach the vent opening(s) 122 in the distal end plate 106. Optionally, the partition body 182 of each side partition 180 defines one or more side partition openings 186, which are discussed in more detail below.

As best shown in FIG. 15, the diffusor baffle 132 is constructed to direct gas flow away from the central opening 134 and into the outer chambers 140 (upper, lower, right, and left), in accordance with some embodiments. For example, the diffusor baffle 132 has a domed, angled, or other shape that promotes lateral flow towards the outer chambers 140. In one embodiment, the upper, lower, right, and left portions of the diffusor baffle 132 are rounded and/or sloped towards an entrance to the respective outer chamber 140. As gases expand into and fill the blast chamber 103 of the proximal end portion 102, the diffusor baffle 132 thus promotes flow of a substantial portion of gases (e.g., 25-60%) to flow into the outer chambers 140.

Figure 19:
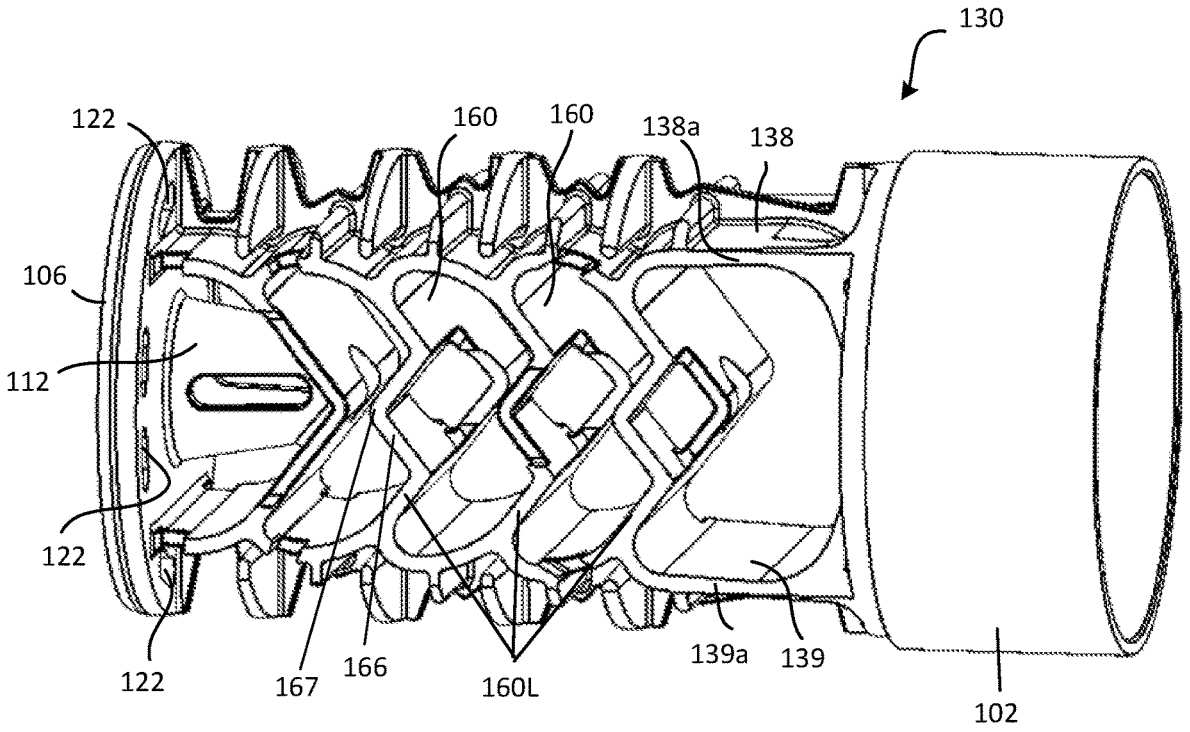
FIG. 19 illustrates a side view of a mono-core suppressor body, in accordance with an embodiment of the present disclosure.
Figure 20:
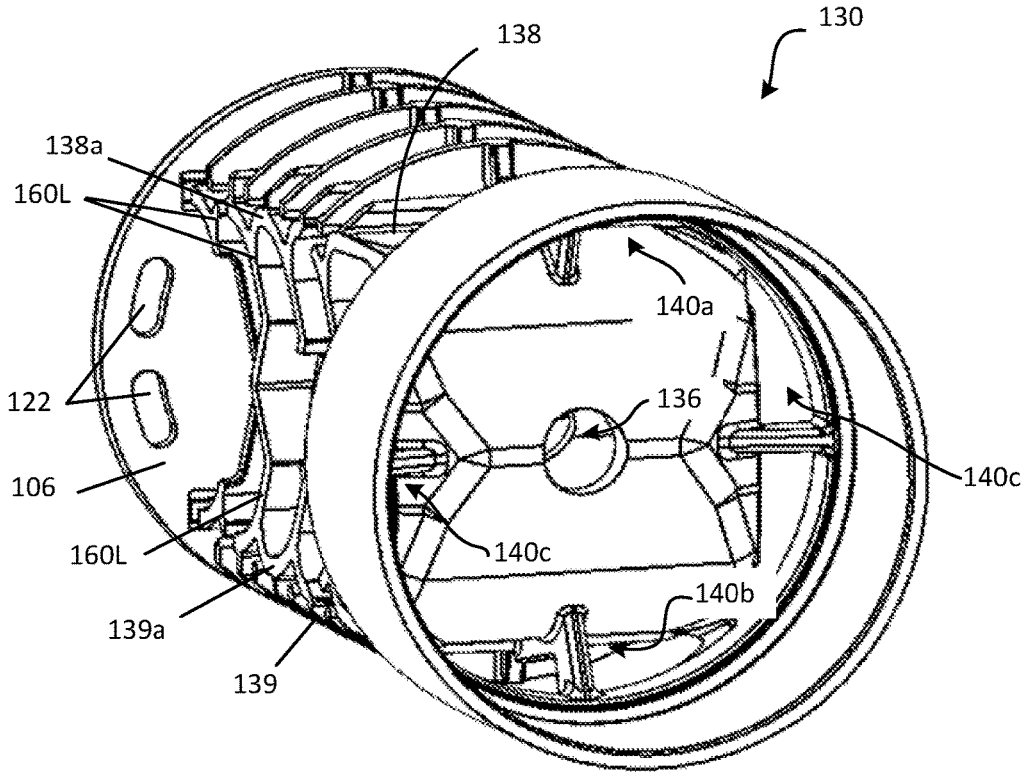
FIG. 20 illustrates a rear perspective view of a mono-core suppressor body, in accordance with an embodiment of the present disclosure.

Referring now to FIGS. 19 and 20, a side view and a rear perspective view, respectively, illustrate a suppressor body 130, in accordance with an embodiment of the present disclosure. The distal end plate 106 defines vent openings 122 at the three, six, nine, and twelve o'clock positions, corresponding to outer chambers 140 along the upper, lower, left, and right portions of the suppressor 100. As can be seen in FIG. 20, the baffles 160 do not extend laterally beyond the lateral margins 138*a*, 139*a* of the upper partition 138 or lower partition 139. In some embodiments, side partitions 180 having a planar partition body 182 can therefore be placed against or secured to the upper partition 138 and lower partition 139. In one embodiment, the lateral margins 138*a*, 139*a* of the partitions and at least part of the lateral margin 160L of the baffles 160 are coplanar, defining a generally flat surface for engagement with or attachment to the side partition 180.

Figure 21:
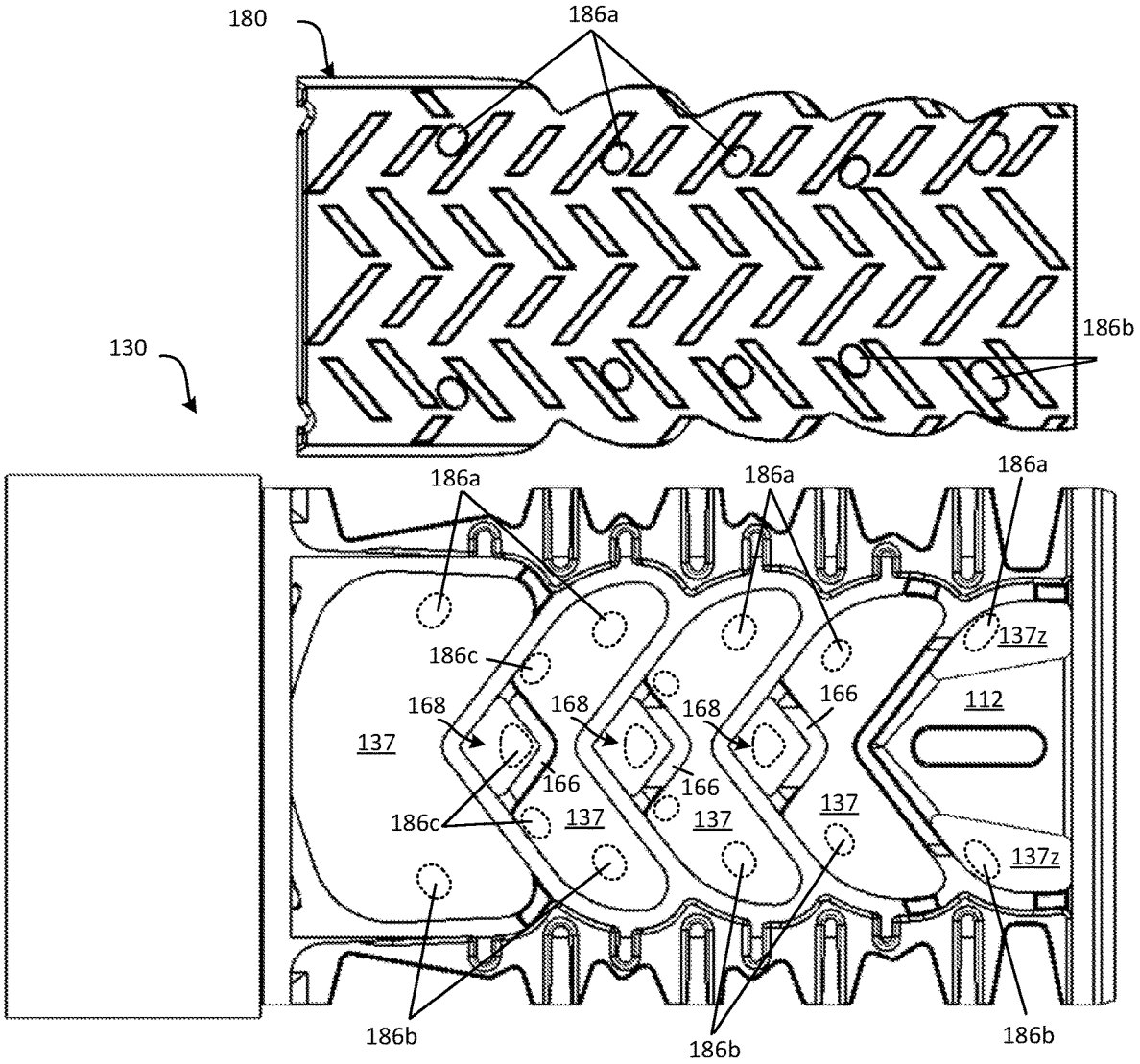
FIG. 21 illustrates a side view showing the right side of a suppressor body and the right-side partition that can be assembled with the suppressor body, in accordance with an embodiment of the present disclosure.
Figure 22:
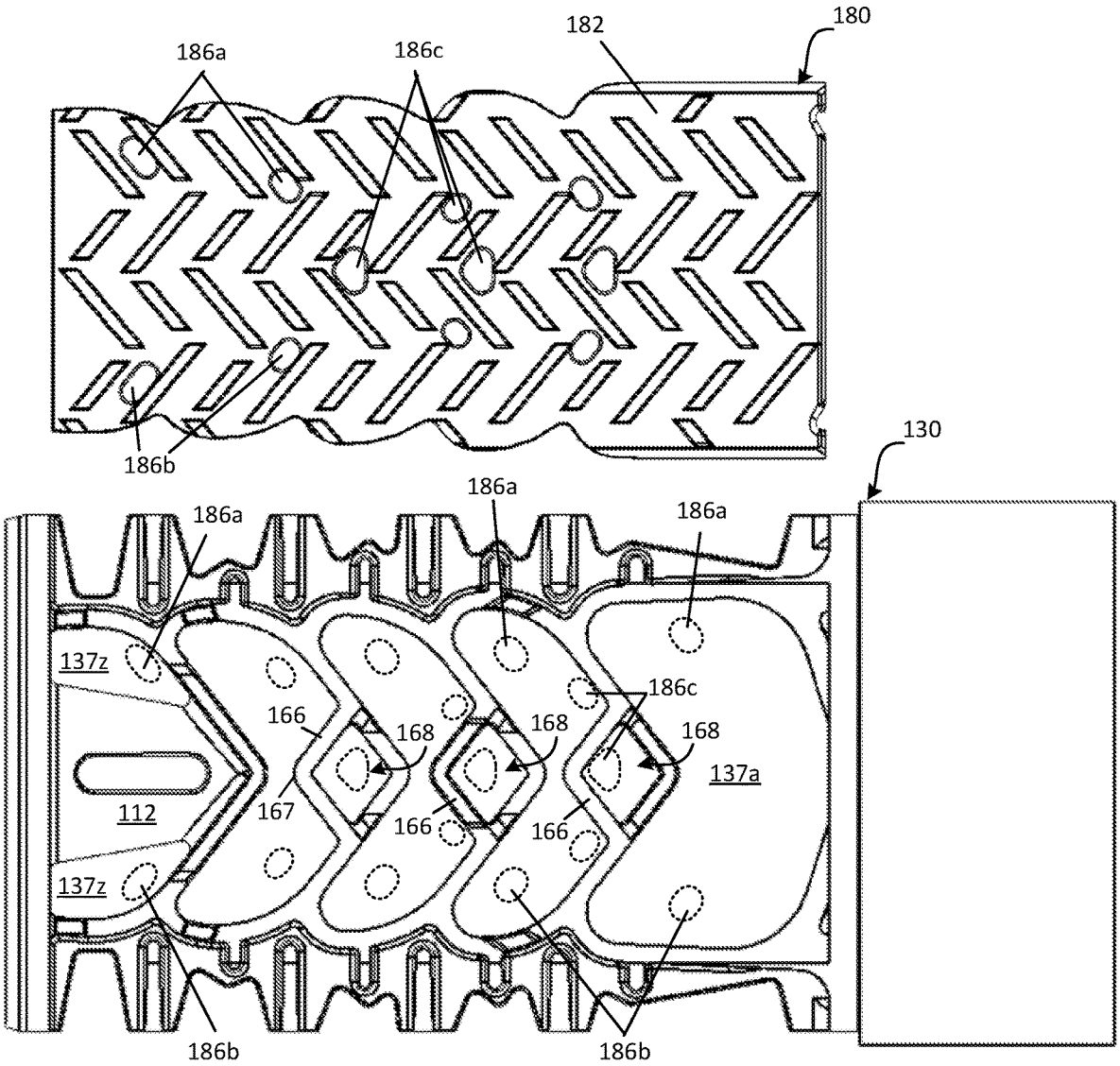
FIG. 22 illustrates a side view showing the left side of a suppressor body and the left-side partition that can be assembled with the suppressor body, in accordance with an embodiment of the present disclosure.

Referring now to FIGS. 21 and 22, right and left side views, respectively, illustrate a suppressor body 130 and side partition 180 in disassembled form to show the position of side partition openings 186 relative to baffles 160 and compartments 137 of the inner chamber 136, in accordance with an embodiment of the present disclosure. In each of FIGS. 21 and 22, the side partition 180 is shown aligned vertically above the position it would occupy when assembled with the suppressor body 130. Side partition openings 186 are shown in broken lines over the suppressor body 130 to indicate their positions when assembled.

In the example embodiment of the right-side partition 180 of FIG. 21, the side partition 180 has side partition openings 186*a* along an upper portion of the side partition and partition openings 186*b* along a lower portion of the side partition. These openings 186*a*, 186*b* correspond to the upper and lower portions of each compartment 137 between adjacent baffles 160 in the inner chamber 136. In the example embodiment of the left-side partition 180 of FIG. 22, the side partition 180 has side partition openings 186*c* along a middle portion of the partition body 182, partition openings 186*a* in the upper portion, and partition openings 186*b* in the lower portion of the partition body 182. The partition openings 186*c* are located to introduce gases through the side openings 168 defined by side portion 166 of the baffles 160. The various locations of partition openings 186 provide gas flow laterally across the inner chamber 136. In some instances, the partition openings 186 corresponds to the location of a pathway defined in the inner chamber 136, such as the side opening 168. In some such embodiments, the partition opening 168 may reinforce a flow path in the inner chamber 136. In other instances, the partition openings 186 correspond to portions of compartments 137 that are less easily filled by gases, such as upper and lower regions, corners, and the like. In any event, partition openings 168 facilitate mixing of gases and filling compartments 137. Numerous variations and embodiments will be apparent in light of the present disclosure.

In one embodiment, the suppressor body 130 has a mono-core construction, such as manufactured using an investment casting process. In another embodiment, the suppressor body 130 (or entire suppressor assembly 100) can be made using direct metal laser sintering (DMLS), also referred to as 3D metal printing. In other embodiments, the suppressor body 130 can be machined or manufactured using other suitable techniques, as will be appreciated. The mount 110 and proximal end portion 102 may be separate components that can be releasably attached or permanently attached (e.g., by welding) to the suppressor body 130. In some embodiments, the distal end plate 106 is made as an integral part of the suppressor body 130. In other embodiments the distal end plate 106 is a separate component that can be attached to the suppressor body 130, such as by a threaded interface or welding. The outer housing 108 can be installed over the suppressor body 130 and secured to the proximal end portion 102 and distal end plate 106, such as by welding or threaded engagement.

Embodiments of the suppressor 100 may be constructed from any suitable material(s), as will be apparent in light of this disclosure. For example, some embodiments of suppressor 100 and its components can be constructed from ANSI 4130 or 4140 steel or from chromium- or austenitic nickel-chromium-based alloys, such as 17-4 Stainless Steel or Inconel alloys 625 or 718. It may be desirable in some instances to ensure that the suppressor assembly 100 comprises a material (or combination of materials), for example, that is corrosion resistant, retains strength over a large temperature range (e.g., in the range of about −50° F. to 1200° F.), and/or resistant to deformation and/or fracture at high pressures (e.g., 600-650 psi throughout and over 1000 psi in localized areas). In a more general sense, embodiments of the suppressor 100 can be constructed from any suitable material which is compliant, for example, with United States Defense Standard MIL-W-13855 (Weapons: Small Arms and Aircraft Armament Subsystems, General Specification For). Other suitable materials for suppressor 100 will depend on a given application and will be apparent in light of this disclosure.

Further Example Embodiments

The following examples pertain to further embodiments, from which numerous permutations and configurations will be apparent.

Example 1 is a suppressor comprising a suppressor body extending along a central axis from a proximal end portion with a proximal end to a distal end, the suppressor body including a blast diffusor adjacent the proximal end portion where the blast diffusor defines a central opening and is configured to direct propellant gases away from the central opening, an end plate at the distal end, the end plate defining a central exit opening, an upper partition connected to and extending from the blast diffusor to the distal end plate, a lower partition connected to and extending from the blast diffusor to the distal end plate, the lower partition spaced vertically from the upper partition, a plurality of baffles axially spaced between the blast diffusor and the end plate, each of the plurality of baffles extending between and connecting the upper partition to the lower partition and defining a baffle opening concentric with the central axis, the plurality of baffles including a distal-most baffle adjacent the end plate. An outer housing is around the suppressor body between the end plate and the proximal end, where the suppressor body defines an inner chamber between the upper partition, the lower partition, the distal end plate, and the blast diffusor, and wherein the suppressor defines a first outer chamber between the upper partition and the outer housing and defines a second outer chamber between the lower partition and the outer housing.

Example 2 includes the subject matter of Example 1 and further comprises a passageway between the baffle opening of the distal-most baffle and the central exit opening in the end plate, the passageway expanding in cross-sectional size moving towards the end plate.

Example 3 includes the subject matter of Example 2, wherein the passageway has a frustoconical shape.

Example 4 includes the subject matter of Example 2 or 3, wherein the passageway connects to the end plate at the central exit opening and connects to the distal-most baffle at the baffle opening.

Example 5 includes the subject matter of any of Examples 2-4, wherein the passageway defines one or more side openings in communication with the inner chamber.

Example 6 includes the subject matter of Example 5, wherein a combined area of the one or more side openings is greater than an area of the central opening of the distal-most baffle.

Example 7 includes the subject matter of any of Examples 1-6, wherein the upper partition and the lower partition each define one or more partition openings so that the first outer chamber and the second outer chamber each fluidly communicate with the inner chamber.

Example 8 includes the subject matter of any of Examples 1-7, wherein the blast diffusor is constructed to direct a first portion of propellant gases into the first outer chamber and to direct a second portion of combustion gases into the second outer chamber.

Example 9 includes the subject matter of any of Examples 1-8, wherein the end plate defines vent openings positioned radially outside of the central exit opening, the vent openings in fluid communication with the first outer chamber and the second outer chamber, wherein the first outer chamber and the second outer chamber are constructed to vent at least in part through the vent openings.

Example 10 includes the subject matter of any of Examples 1-9 and further comprises a mount attached to the proximal end portion of the suppressor body, the mount configured for direct or indirect attachment to a firearm barrel, the suppressor defining a blast chamber between the mount and the blast diffusor.

Example 11 includes the subject matter of Example 10, wherein the mount includes a muzzle device in the blast chamber, the muzzle device selected from a muzzle adapter, a flash hider, and a muzzle brake, wherein the mount is configured to attach to the muzzle device and the muzzle device is configured to attach to the firearm barrel.

Example 12 includes the subject matter of any of Examples 1-12, wherein the blast diffusor defines one or more vent openings defining a passageway from the blast chamber into the inner chamber.

Example 13 includes the subject matter of any of Examples 1-11 and further comprises a first side partition on a first side of the inner chamber and a second side partition on an opposite second side of the inner chamber, the first and second side partitions extending vertically between the upper partition and the lower partition such that the suppressor defines a third outer chamber between the first side partition and the outer housing and a fourth outer chamber between the second side partition and the outer housing.

Example 14 includes the subject matter of Example 13, wherein the upper partition, the lower partition, the first side partition, and the second side partition generally define a cuboid volume of the inner chamber.

Example 15 includes the subject matter of Example 13 or 14, wherein each of the side partitions defines one or more side partition openings such that the respective third outer chamber and fourth outer chamber fluid communicate with the inner chamber.

Example 16 includes the subject matter of any of Examples 13-15, wherein the first side partition and the second side partition each includes a plurality of flow-directing structures.

Example 17 includes the subject matter of any of Examples 13-16, wherein the third chamber and the fourth chamber vent through openings in the end plate independently or semi-independently from the inner chamber.

Example 18 includes the subject matter of any of Examples 13-17, wherein the blast diffusor is constructed to divert a portion of combustion gases to each of the first outer chamber, the second outer chamber, the third outer chamber, and the fourth outer chamber.

Example 19 includes the subject matter of any of Examples 1-18, wherein at least one baffle of the plurality of baffles has a V-shape with a vertex pointing rearward and a side portion having a reverse V-shape having a vertex pointing forward.

Example 20 includes the subject matter of any of Examples 1-18, wherein at least one baffle of the plurality of baffles has a convex portion and a concave portion laterally adjacent the convex portion.

Example 21 includes the subject matter of any of Examples 1-20, wherein the suppressor includes flow-directing structures in the first outer chamber and in the second outer chamber, the flow-directing structures requiring a non-linear gas flow path from the proximal end portion to the distal end plate.

Example 22 includes the subject matter of any of Examples 1-21, wherein the first outer chamber and the second outer chamber are constructed to vent independently or semi-independently of the inner chamber.

Example 23 includes the subject matter of any of Examples 1-22, wherein the suppressor body is a single, monolithic structure.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A suppressor comprising:

a suppressor body extending along a central axis from a proximal end portion with a proximal end to a distal end, the suppressor body including:

a blast diffusor adjacent the proximal end portion, the blast diffusor defining a central opening and configured to direct propellant gases away from the central axis;

an end plate at the distal end, the end plate defining a central exit opening;

an upper partition connected to and extending from the blast diffusor to the distal end plate;

a lower partition connected to and extending from the blast diffusor to the distal end plate, the lower partition spaced vertically from the upper partition; and a plurality of baffles axially spaced between the blast diffusor and the end plate, each of the plurality of baffles extending between and connecting the upper partition to the lower partition and defining a baffle opening concentric with the central axis, the plurality of baffles including a distal-most baffle adjacent the end plate; and an outer housing around the suppressor body between the end plate and the proximal end, wherein the suppressor body defines an inner chamber between the upper partition, the lower partition, the distal end plate, and the blast diffusor, and wherein the suppressor defines a first outer chamber between the upper partition and the outer housing and defines a second outer chamber between the lower partition and the outer housing, wherein the blast diffusor is constructed to direct a first portion of propellant gases into the first outer chamber and to direct a second portion of combustion gases into the second outer chamber.

2. The suppressor of claim 1 further comprising a passageway connecting the baffle opening of the distal-most baffle to the central exit opening in the end plate, the passageway expanding in cross-sectional size moving towards the end plate.

3. The suppressor of claim 2, wherein the passageway has a frustoconical shape.

4. The suppressor of claim 2, wherein a wall defining the passageway defines one or more vent openings so that the passageway communicates with the inner chamber via the one or more vent openings.

5. The suppressor of claim 4, wherein a combined area of the one or more vent openings is greater than an area of the central opening of the distal-most baffle.

6. The suppressor of claim 1, wherein the upper partition and the lower partition each define one or more partition openings so that the first outer chamber and the second outer chamber each fluidly communicate with the inner chamber.

7. The suppressor of claim 1, wherein the end plate defines vent openings positioned radially outside of the central exit opening, the vent openings in fluid communication with the first outer chamber and the second outer chamber, wherein the first outer chamber and the second outer chamber are constructed to vent combustion gases to the atmosphere at least in part through the vent openings.

8. The suppressor of claim 1 further comprising a mount attached to the proximal end portion of the suppressor body, the mount configured for direct or indirect attachment to a firearm barrel, the suppressor defining a blast chamber between the mount and the blast diffusor.

9. The suppressor of claim 8, wherein the blast diffusor defines one or more vent openings defining a passageway from the blast chamber into the inner chamber.

10. A suppressor comprising:

a suppressor body extending along a central axis from a proximal end portion with a proximal end to a distal end, the suppressor body including:

a blast diffusor adjacent the proximal end portion, the blast diffusor defining a central opening and configured to direct propellant gases away from the central axis;

an end plate at the distal end, the end plate defining a central exit opening;

an upper partition connected to and extending from the blast diffusor to the distal end plate;

a lower partition connected to and extending from the blast diffusor to the distal end plate, the lower partition spaced vertically from the upper partition; and a plurality of baffles axially spaced between the blast diffusor and the end plate, each of the plurality of baffles extending between and connecting the upper partition to the lower partition and defining a baffle opening concentric with the central axis, the plurality of baffles including a distal-most baffle adjacent the end plate;

an outer housing around the suppressor body between the end plate and the proximal end;

a mount attached to the proximal end portion of the suppressor body, the mount configured for direct or indirect attachment to a firearm barrel, the suppressor defining a blast chamber between the mount and the blast diffusor, wherein the mount includes a muzzle device in the blast chamber, the muzzle device selected from a muzzle adapter, a flash hider, and a muzzle brake, wherein the mount is configured to attach to the muzzle device and the muzzle device is configured to attach to the firearm barrel; and wherein the suppressor body defines an inner chamber between the upper partition, the lower partition, the distal end plate, and the blast diffusor, and wherein the suppressor defines a first outer chamber between the upper partition and the outer housing and defines a second outer chamber between the lower partition and the outer housing.

11. The suppressor of claim 1 further comprising a first side partition on a first side of the inner chamber and a second side partition on an opposite second side of the inner chamber, the first and second side partitions extending vertically between the upper partition and the lower partition such that the suppressor defines a third outer chamber between the first side partition and the outer housing and a fourth outer chamber between the second side partition and the outer housing.

12. The suppressor of claim 11, wherein the upper partition, the lower partition, the first side partition, and the second side partition generally define a cuboid volume of the inner chamber.

13. The suppressor of claim 11, wherein each of the side partitions defines one or more side partition openings placing the respective third outer chamber or fourth outer chamber in fluid communication with the inner chamber.

14. The suppressor of claim 13, wherein the first side partition and the second side partition each includes a plurality of flow-directing structures.

15. The suppressor of claim 11, wherein the third chamber and the fourth chamber vent through openings in the end plate independently or semi-independently from the inner chamber.

16. The suppressor of claim 11, wherein the blast diffusor is constructed to divert a portion of combustion gases to each of the first outer chamber, the second outer chamber, the third outer chamber, and the fourth outer chamber.

17. The suppressor of claim 1, wherein the suppressor body is a single, monolithic structure.

18. The suppressor of claim 1, wherein at least one baffle of the plurality of baffles has a V-shape with a vertex pointing rearward and a side portion having a reverse V-shape having a vertex pointing forward.

19. The suppressor of claim 1, wherein at least one baffle of the plurality of baffles has a convex portion and a concave portion laterally adjacent the convex portion.

20. The suppressor of claim 1, wherein the suppressor includes flow-directing structures in the first outer chamber and in the second outer chamber, the flow-directing structures requiring a non-linear gas flow path from the proximal end portion to the distal end plate.

21. The suppressor of claim 1, wherein the first outer chamber and the second outer chamber are constructed to vent independently or semi-independently of the inner chamber.

22. A suppressor comprising:

a suppressor body extending along a central axis from a proximal end portion with a proximal end to a distal end, the suppressor body including:

a blast diffusor adjacent the proximal end portion, the blast diffusor defining a central opening and configured to direct propellant gases away from the central axis;

an end plate at the distal end, the end plate defining a central exit opening;

an upper partition connected to and extending from the blast diffusor to the distal end plate;

a lower partition connected to and extending from the blast diffusor to the distal end plate, the lower partition spaced vertically from the upper partition; and a plurality of baffles axially spaced between the blast diffusor and the end plate, each of the plurality of baffles extending between and connecting the upper partition to the lower partition and defining a baffle opening concentric with the central axis, the plurality of baffles including a distal-most baffle adjacent the end plate; and an outer housing around the suppressor body between the end plate and the proximal end, wherein the suppressor body defines an inner chamber between the upper partition, the lower partition, the distal end plate, and the blast diffusor, and wherein the suppressor defines a first outer chamber between the upper partition and the outer housing and defines a second outer chamber between the lower partition and the outer housing, wherein gases from a firearm barrel impinging on the blast diffusor flow into the inner chamber, the first outer chamber, and the second outer chamber.

23. The suppressor of claim 22 further comprising a frustoconical passageway connecting the baffle opening of the distal-most baffle to the central exit opening in the end plate, the passageway expanding in cross-sectional size moving towards the end plate.

* * * * *